US010971074B2

(12) United States Patent
Yamashita et al.

(10) Patent No.: US 10,971,074 B2
(45) **Date of Patent: *Apr. 6, 2021**

(54) DISPLAYS WITH MULTIPLE SCANNING MODES

(71) Applicant: Apple Inc., Cupertino, CA (US)

(72) Inventors: Keitaro Yamashita, San Jose, CA (US); Abbas Jamshidi Roudbari, San Jose, CA (US); Shin-Hung Yeh, Taipei (TW); Tsung-Ting Tsai, Cupertino, CA (US); Shih-Chang Chang, Cupertino, CA (US); Ting-Kuo Chang, San Jose, CA (US); Ki Yeol Byun, Santa Clara, CA (US); Warren S. Rieutort-Louis, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/712,050

(22) Filed: Dec. 12, 2019

(65) Prior Publication Data

US 2020/0118497 A1 Apr. 16, 2020

Related U.S. Application Data

(60) Continuation of application No. 16/577,597, filed on Sep. 20, 2019, now Pat. No. 10,546,540, which is a (Continued)

(51) Int. Cl.
*G09G 3/3266* (2016.01)

(52) U.S. Cl.
CPC ... *G09G 3/3266* (2013.01); *G09G 2300/0413* (2013.01); *G09G 2310/0205* (2013.01); (Continued)

(58) Field of Classification Search
CPC ..... G09G 3/30–3291; G09G 3/3644; G09G 3/3666; G09G 2300/0413; (Continued)

(56) References Cited

U.S. PATENT DOCUMENTS 5,712,652 A 1/1998 Sato et al.
6,181,317 B1 1/2001 Taguchi et al.
(Continued)

FOREIGN PATENT DOCUMENTS

CN 1388511 A 1/2003
CN 1428760 A 7/2003
(Continued)

OTHER PUBLICATIONS

Chang et al., U.S. Appl. No. 15/403,070, filed Jan. 10, 2017.

*Primary Examiner* — Gene W Lee
(74) *Attorney, Agent, or Firm* — Treyz Law Group, P.C.; Joseph F. Guihan

(57) ABSTRACT

An electronic device may include a display such as a light-emitting diode display. The electronic device may be a head-mounted device that provides a virtual reality or augmented reality environment to a user. To reduce artifacts in the display, a display may be operable in both a normal scanning mode and a partial scanning mode. In the normal scanning mode, every row of the display may be enabled to emit light in each frame. In the partial scanning mode, only a subset of the rows of the display may be enabled to emit light in each frame. The display may have a higher refresh rate in the partial scanning mode than in the normal scanning mode. To ensure uniform transistor stress across the display, the scanning driver for the display may scan the disabled rows in the partial scanning mode even though the rows will not be used to emit light.

17 Claims, 26 Drawing Sheets

Related U.S. Application Data division of application No. 15/384,096, filed on Dec. 19, 2016, now Pat. No. 10,482,822.

(60) Provisional application No. 62/422,718, filed on Nov. 16, 2016, provisional application No. 62/385,411, filed on Sep. 9, 2016.

(52) U.S. Cl.
CPC ..... *G09G 2310/0213* (2013.01); *G09G 2310/0221* (2013.01); *G09G 2310/0267* (2013.01); *G09G 2310/0286* (2013.01); *G09G 2310/04* (2013.01); *G09G 2340/0414* (2013.01); *G09G 2340/0435* (2013.01)

(58) Field of Classification Search
CPC ... G09G 2310/0205; G09G 2310/0221; G09G 2310/0286; G09G 2310/04
See application file for complete search history.

(56) References Cited

U.S. PATENT DOCUMENTS 6,473,077 B1 * 10/2002 Takenaka ..... G09G 3/3648 345/100
6,667,730 B1 12/2003 Taguchi et al.
6,937,224 B1 * 8/2005 Miyachi ..... G09G 3/3677 345/102
7,196,700 B1 3/2007 Aho et al.
7,315,332 B2 * 1/2008 Van Lammeren ..... H04N 5/44504 348/468
7,602,365 B2 10/2009 Endo et al.
7,714,832 B2 5/2010 Tong et al.
8,120,552 B2 * 2/2012 Kimura ..... G09G 3/3275 345/76
8,130,216 B2 3/2012 Washio et al.
8,378,950 B2 2/2013 Endo et al.
8,629,889 B2 * 1/2014 Eom ..... G09G 3/3266 345/690
9,262,981 B2 2/2016 Wang
9,412,314 B2 8/2016 Amundson et al.
9,449,994 B2 9/2016 Kwon et al.
9,460,682 B2 10/2016 Ahn et al.
2004/0222951 A1 11/2004 Lee et al.
2005/0264498 A1 12/2005 Asano
2006/0022933 A1 2/2006 Endo et al.
2010/0309230 A1 12/2010 Cho
2011/0193892 A1 8/2011 Eom
2012/0038609 A1 * 2/2012 Chung ..... G09G 3/3266 345/211
2012/0313904 A1 * 12/2012 Wang ..... G09G 3/20 345/204
2013/0293529 A1 11/2013 You et al.
2014/0340297 A1 * 11/2014 Oke ..... G09G 3/3688 345/103
2015/0085000 A1 * 3/2015 Lin ..... G09G 3/20 345/694
2016/0225311 A1 8/2016 Hwang et al.
2016/0267713 A1 9/2016 Patel

FOREIGN PATENT DOCUMENTS

CN 1705008 A 12/2005
CN 1885379 A 12/2006
CN 102148009 A 8/2011
CN 103137081 A 6/2013
CN 103680439 A 3/2014
CN 103680443 A 3/2014
CN 104424906 A 3/2015
CN 105513556 A 4/2016
EP 0456165 A2 11/1991
JP 2000250495 A 9/2000

* cited by examiner

DISPLAYS WITH MULTIPLE SCANNING MODES

This application is a continuation of non-provisional patent application Ser. No. 16/577,597, filed Sep. 20, 2019, which is division of non-provisional patent application Ser. No. 15/384,096, filed Dec. 19, 2016, which claims the benefit of provisional patent application No. 62/385,411, filed on Sep. 9, 2016, and provisional patent application No. 62/422,718, filed on Nov. 16, 2016, all of which are hereby incorporated by reference herein in their entireties.

BACKGROUND

This relates generally to displays, and, more particularly, to displays with multiple scanning modes.

Electronic devices often include displays. For example, cellular telephones and portable computers include displays for presenting information to users. An electronic device may have an organic light-emitting diode display based on organic-light-emitting diode pixels or a liquid crystal display based on liquid crystal pixels. Displays may be incorporated in devices that are mounted on a user's head such as virtual reality and augmented reality headsets.

It can be challenging to design devices such as these. The display may have a high resolution and may sometimes need to operate at a high refresh rate, resulting in each row in the display having a low scan time. This may result in poor display uniformity and other visible artifacts.

It would therefore be desirable to be able to provide an improved display that can operate at normal and high refresh rates.

SUMMARY

An electronic device may include a display such as a light-emitting diode display. The electronic device may be a head-mounted device that provides a virtual reality or augmented reality environment to the user.

Displays may be provided with high resolution and may operate with high refresh rates. To reduce image artifacts in the display at high refresh rates, a display may be operable in both a normal scanning mode and a partial scanning mode. In the normal scanning mode, every row of the display may be scanned in each frame. In the partial scanning mode, only a subset of the rows of the display may be scanned in each frame. The display may have a higher refresh rate in the partial scanning mode than in the normal scanning mode.

The display may include an array of pixels formed in an active area of the display, display driver circuitry formed in an inactive area of the display that is configured to provide image data to the pixels, and gate driver circuitry formed in the inactive area of the display. The gate driver circuitry may include a shift register that includes a plurality of register circuits. Each register circuit may have at least one output that is provided to a corresponding row of pixels. At least one register circuit in the shift register may have a first input and a second input that is different than the first input. The first input may be used when the display operates in the normal scanning mode and the second input may be used when the display operates in the partial scanning mode.

The display may be divided into sections, some of which are enabled only during the normal scanning mode. During the partial scanning mode, some of the sections may be disabled. The gate driver circuitry may include a gate driver and an emission driver with portions that correspond to respective sections of the display.

By selectively disabling sections of the display during the partial scanning mode, display performance may be improved and power may be conserved. However, the display sections that are disabled during the partial scanning mode may experience less thin film transistor (TFT) stress than the display sections that are not disabled during the partial scanning mode. Over time, this imbalance in TFT stress may cause visible artifacts in the display. To equalize the amount of permanent TFT stress in each section of the display, the scan driver of the sections that are disabled during the partial scanning mode may still scan the disabled rows during the partial scanning mode (even though the disabled rows do not display images).

DETAILED DESCRIPTION

Figure 1:
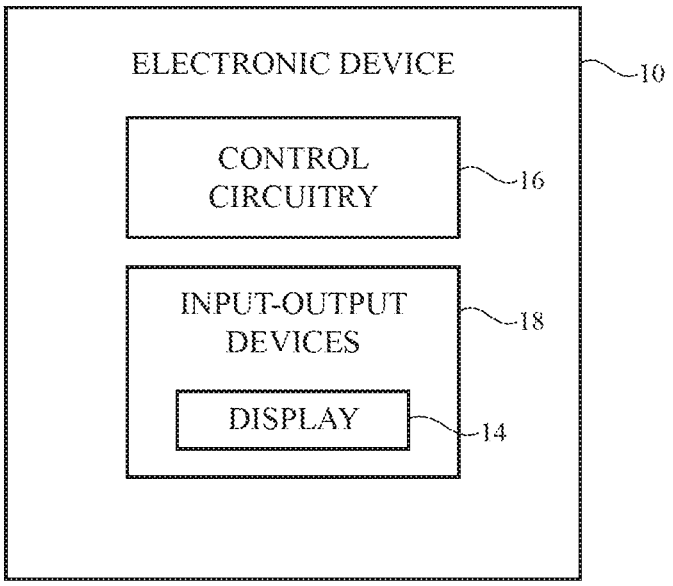
FIG. 1 is a schematic diagram of an illustrative electronic device having a display in accordance with an embodiment.

An illustrative electronic device of the type that may be provided with a display is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a display, a computer display that contains an embedded computer, a computer display that does not contain an embedded computer, a gaming device, a navigation device, an embedded system such as a system in which electronic equipment with a display is mounted in a kiosk or automobile, or other electronic equipment. Electronic device 10 may have the shape of a pair of eyeglasses (e.g., supporting frames), may form a housing having a helmet shape, or may have other configurations to help in mounting and securing the components of one or more displays on the head or near the eye of a user.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 18 may be used to allow data to be supplied to device 10 and to allow data to be provided from device 10 to external devices. Input-output devices 18 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 18 and may receive status information and other output from device 10 using the output resources of input-output devices 18.

Input-output devices 18 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14.

Display 14 may be an organic light-emitting diode display, a display formed from an array of discrete light-emitting diodes each formed from a crystalline semiconductor die, or any other suitable type of display. Configurations in which the pixels of display 14 include light-emitting diodes are sometimes described herein as an example. This is, however, merely illustrative. Any suitable type of display may be used for device 10, if desired.

Figure 2:
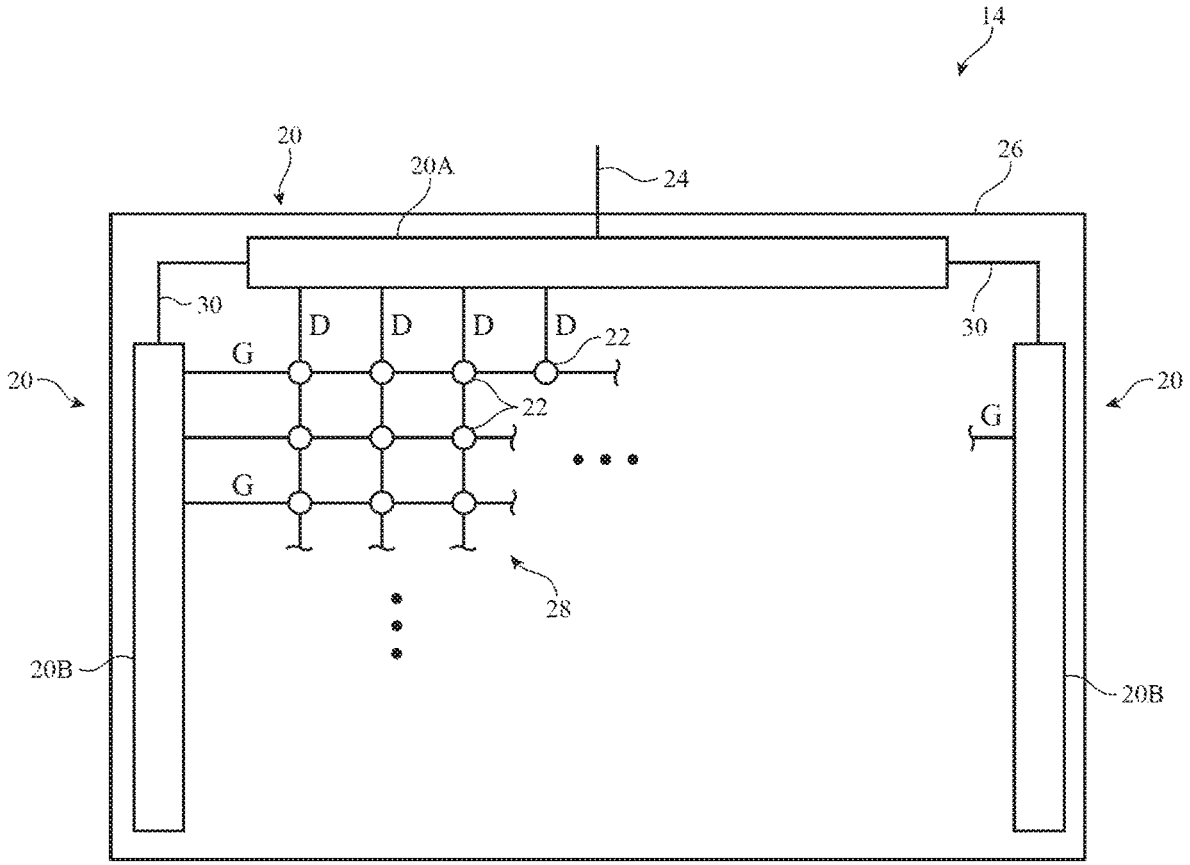
FIG. 2 is a schematic diagram of an illustrative display in accordance with an embodiment.

FIG. 2 is a diagram of an illustrative display. As shown in FIG. 2, display 14 may include layers such as substrate layer 26. Substrate layers such as layer 26 may be formed from rectangular planar layers of material or layers of material with other shapes (e.g., circular shapes or other shapes with one or more curved and/or straight edges). The substrate layers of display 14 may include glass layers, polymer layers, composite films that include polymer and inorganic materials, metallic foils, etc.

Display 14 may have an array of pixels 22 for displaying images for a user such as pixel array 28. Pixels 22 in array 28 may be arranged in rows and columns. The edges of array 28 may be straight or curved (i.e., each row of pixels 22 and/or each column of pixels 22 in array 28 may have the same length or may have a different length). There may be any suitable number of rows and columns in array 28 (e.g., ten or more, one hundred or more, or one thousand or more, etc.). Display 14 may include pixels 22 of different colors. As an example, display 14 may include red pixels, green pixels, and blue pixels. If desired, a backlight unit may provide backlight illumination for display 14.

Display driver circuitry 20 may be used to control the operation of pixel array 28. Display driver circuitry 20 may be formed from integrated circuits, thin-film transistor circuits, and/or other suitable circuitry. Illustrative display driver circuitry 20 of FIG. 2 includes display driver circuitry 20A and additional display driver circuitry such as gate driver circuitry 20B. Gate driver circuitry 20B may be formed along one or more edges of display 14. For example, gate driver circuitry 20B may be arranged along the left and right sides of display 14 as shown in FIG. 2. Gate driver circuitry 20B may include gate drivers and emission drivers.

As shown in FIG. 2, display driver circuitry 20A (e.g., one or more display driver integrated circuits, thin-film transistor circuitry, etc.) may contain communications circuitry for communicating with system control circuitry over signal path 24. Path 24 may be formed from traces on a flexible printed circuit or other cable. The control circuitry may be located on one or more printed circuits in electronic device 10. During operation, the control circuitry (e.g., control circuitry 16 of FIG. 1) may supply circuitry such as a display driver integrated circuit in circuitry 20 with image data for images to be displayed on display 14. Display driver circuitry 20A of FIG. 2 is located at the top of display 14. This is merely illustrative. Display driver circuitry 20A may be located at both the top and bottom of display 14 or in other portions of device 10.

To display the images on pixels 22, display driver circuitry 20A may supply corresponding image data to data lines D while issuing control signals to supporting display driver circuitry such as gate driver circuitry 20B over signal paths 30. With the illustrative arrangement of FIG. 2, data lines D run vertically through display 14 and are associated with respective columns of pixels 22.

Gate driver circuitry 20B (sometimes referred to as gate line driver circuitry or horizontal control signal circuitry) may be implemented using one or more integrated circuits and/or may be implemented using thin-film transistor circuitry on substrate 26. Horizontal control lines G (sometimes referred to as gate lines, scan lines, emission control lines, etc.) run horizontally through display 14. Each gate line G is associated with a respective row of pixels 22. If desired, there may be multiple horizontal control lines such as gate lines G associated with each row of pixels. Individually controlled and/or global signal paths in display 14 may also be used to distribute other signals (e.g., power supply signals, etc.).

Gate driver circuitry 20B may assert control signals on the gate lines G in display 14. For example, gate driver circuitry 20B may receive clock signals and other control signals from circuitry 20A on paths 30 and may, in response to the received signals, assert a gate line signal on gate lines G in sequence, starting with the gate line signal G in the first row of pixels 22 in array 28. As each gate line is asserted, data from data lines D may be loaded into a corresponding row of pixels. In this way, control circuitry such as display driver circuitry 20A and 20B may provide pixels 22 with signals that direct pixels 22 to display a desired image on display 14. Each pixel 22 may have a light-emitting diode and circuitry (e.g., thin-film circuitry on substrate 26) that responds to the control and data signals from display driver circuitry 20.

Figure 3:
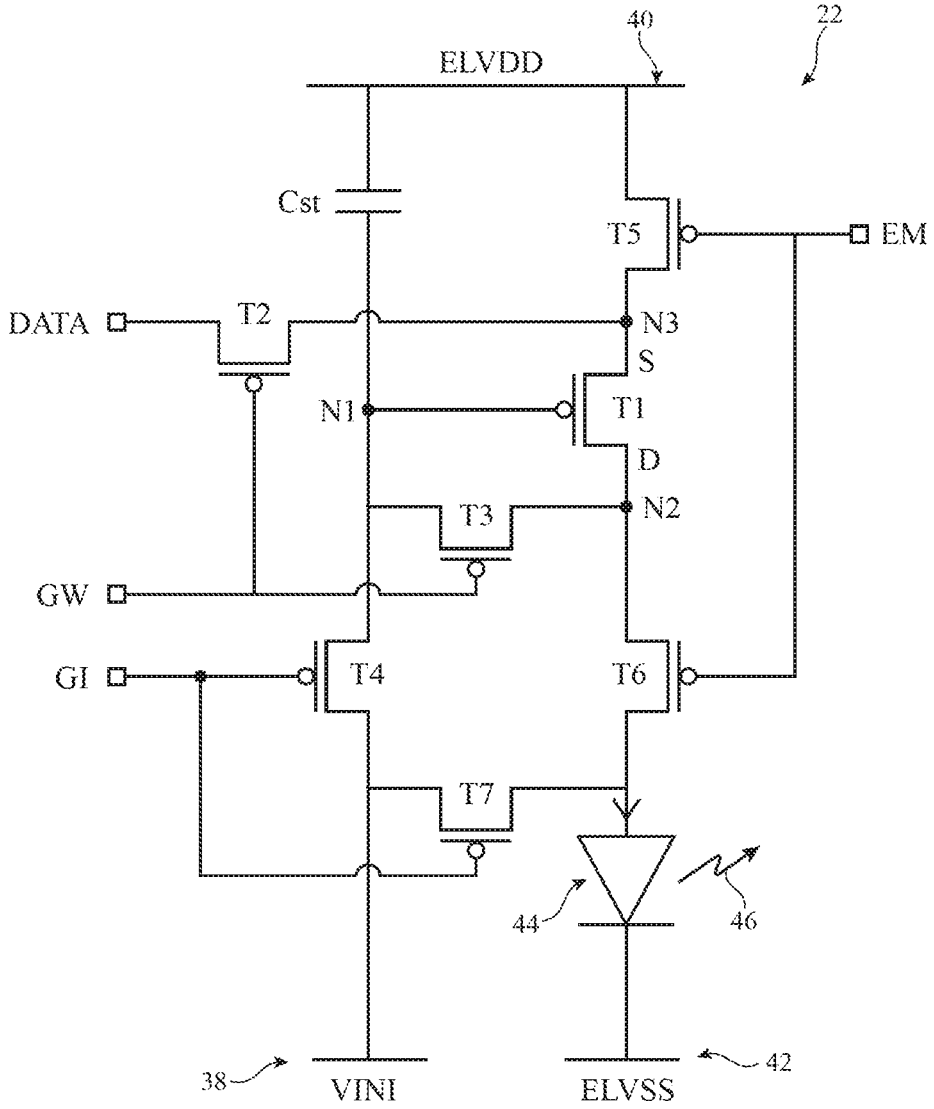
FIG. 3 is a diagram of an illustrative pixel circuit in accordance with an embodiment.

An illustrative pixel circuit of the type that may be used for each pixel 22 in array 28 is shown in FIG. 3. In the example of FIG. 3, pixel circuit 22 has seven transistors T1, T2, T3, T4, T5, T6, and T7 and one capacitor Cst, so pixel circuit 22 may sometimes be referred to as a 7T1C pixel circuit. Other numbers of transistors and capacitors may be used in pixels 22 if desired. The transistors may be p-channel transistors and/or may be n-channel transistors or other types of transistors. The active regions of thin-film transistors for pixel circuit 22 and other portions of display 14 may be formed from silicon (e.g., polysilicon channel regions), semiconducting oxides (e.g., indium gallium zinc oxide channel regions), or other suitable semiconductor thin-film layers.

As shown in FIG. 3, pixel circuit 22 includes light-emitting diode 44 (e.g., an organic light-emitting diode, a crystalline micro-light-emitting diode die, etc.). Light-emitting diode 44 may emit light 46 in proportion to the amount of current I that is driven through light-emitting diode 44 by transistor T1. Transistor T5, Transistor T1, Transistor T6, and light-emitting diode 44 may be coupled in series between respective power supply terminals (see, e.g., positive power supply terminal 40 (ELVDD) and ground power supply terminal 42 (ELVSS). Transistor T1 may have a source terminal (S) coupled to positive power supply terminal 40, a drain terminal (D) coupled to node N2, and a gate terminal coupled to node N1. The terms "source" and "drain" terminals of a transistor can sometimes be used interchangeably and may therefore be referred to herein as "source-drain" terminals. The voltage on node N1 at the gate of transistor T1 controls the amount of current I that is produced by transistor T1. This current is driven through light-emitting diode 44, so transistor T1 may sometimes be referred to as a drive transistor.

Transistors T5 and T6 can be turned off to interrupt current flow between transistor T1 and diode 44 and may be turned on to enable current flow between transistor T1 and diode 44. Emission enable control signal EM is applied to the gates of transistors T5 and T6. During operation, transistors T5 and T6 are controlled by emission enable control signal EM and are sometimes referred to as emission transistors or emission enable transistors. Control signals GW and GI, which may sometimes be referred to as switching transistor control signals, are applied to the gates of switching transistors T2, T3, T4, and T7 and control the operation of transistors T2, T3, T4, and T7. In particular, control signal GW is used to control transistors T2 and T3, while control signal GI is used to control transistors T4 and T7. The capacitor Cst of pixel circuit 22 may be used for data storage. Pixel 22 may also include reference voltage terminal 38 (VINI). Reference voltage terminal 38 may be used to supply a reference voltage (e.g., VINI may be approximately −3.4 Volts or any other desired voltage).

Operation of pixel 22 may be generally have two primary phases: a data writing phase and an emission phase. During the data writing phase, data may be loaded from data lines D (labeled as DATA in FIG. 3) to node N1. The data may be a data voltage that is loaded to Node 1 by turning on transistors T2, T1, and T3. After the data voltage has been loaded into pixel 22, display driver circuitry 20 places pixel 22 in its emission state. During the emission state, the value of the data voltage on node N1 controls the state of drive transistor T1 and thereby controls the amount of light 46 emitted by light-emitting diode 44.

It should be noted that manufacturing variations and variations in operating conditions can cause the threshold voltages of drive transistor T1 to vary. This may cause pixel brightness fluctuations which may give rise to undesired visible artifacts on a display. To help reduce visible artifacts, display 14 may employ any desired threshold voltage compensation techniques to compensate for threshold voltage variation in drive transistor T1.

The example of a 7T1C light-emitting diode pixel shown in FIG. 3 is merely illustrative. If desired, the transistors of the pixel may have a different arrangement than the arrangement shown in FIG. 3. Additional transistors or fewer transistors may be included in the pixel if desired.

Figure 4:
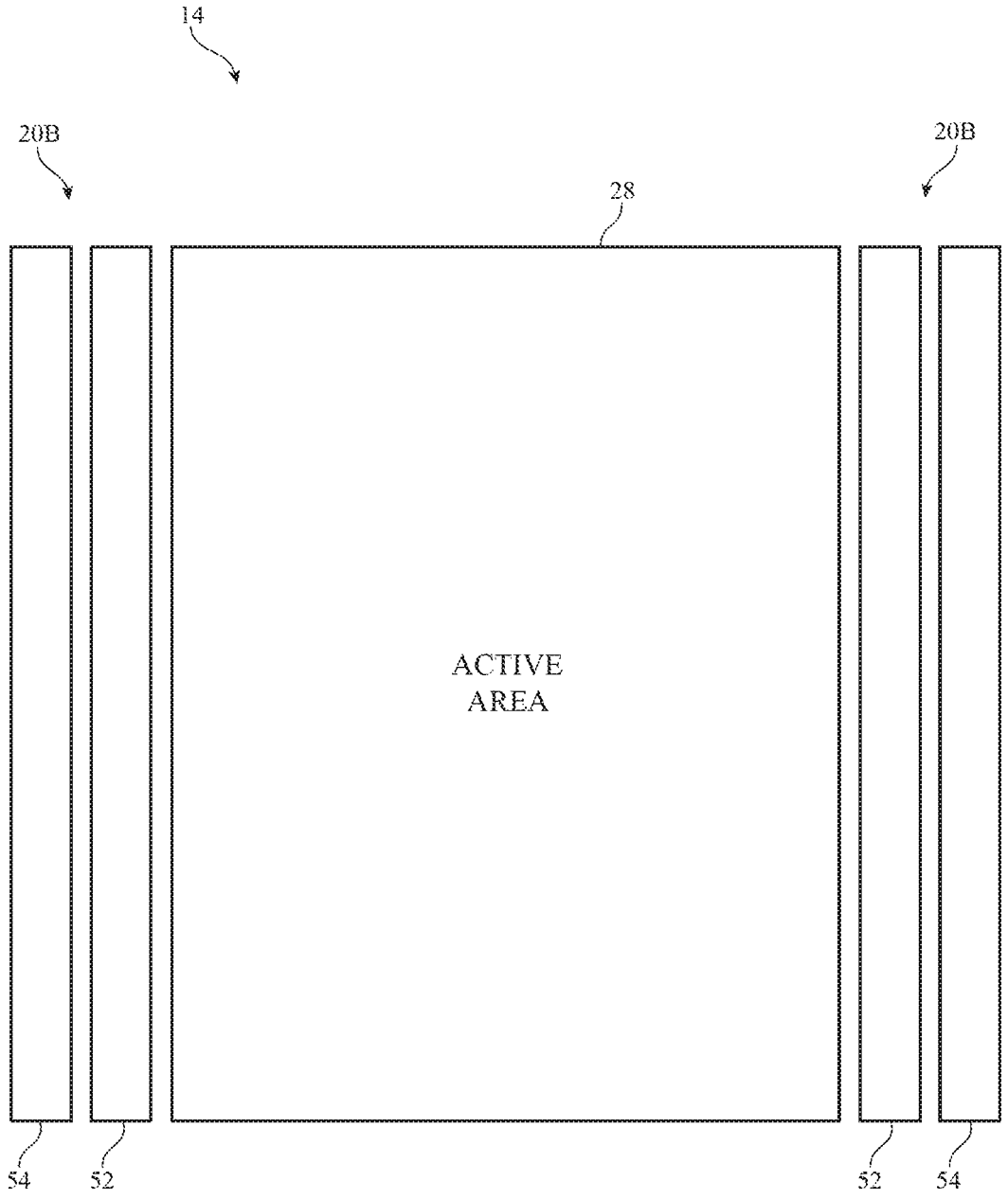
FIG. 4 is a top view of an illustrative display showing how the display's gate driver circuitry may include one or more gate drivers and one or more emission drivers in accordance with an embodiment.

FIG. 4 shows a top view of an illustrative display with gate driver circuitry that includes a gate driver and an emission driver. Gate driver circuitry 20B may be formed along one or more edges of display 14. FIG. 4 shows an example where gate driver circuitry 20B is formed on opposing sides of pixel array 28 (sometimes referred to as an active area). For example, gate driver circuitry 20B may be arranged along the left and right sides of display 14. Gate driver circuitry 20B may include gate drivers (sometimes referred to as scan drivers or scanning drivers) and emission drivers on each side of the active area. FIG. 4 shows gate drivers 52 and emission drivers 54 on opposing sides of the active area. The gate drivers may be configured to supply control signals to each pixel in the display (i.e., the gate drivers may supply switching transistor control signals GW and GI to transistors T2, T3, T4, and T7 in each pixel 22 of FIG. 3). The emission drivers may be configured to supply an emission enable control signal EM to the gates of transistors such as transistors T5 and T6 of pixel 22 in FIG. 3. The emission and gate drivers may be used to address a respective half of the pixel array. For example, the gate driver 52 to the left of the active area may be used to address pixels on the left half of the display, and the gate driver 52 to the right of the active area may be used to address pixels on the right half of the display. Similarly, the emission driver 54 to the left of the active area may be used to address pixels on the left half of the display, and the emission driver 54 to the right of the active area may be used to address pixels on the right half of the display.

The example of having a scan driver and gate driver on two opposing sides of the active area of display 14 is merely illustrative. If desired, gate driver circuitry 20B may be formed on only one side of the active area, on three or more sides of the area, or in any other desired location within the electronic device.

Each emission driver and scan driver may contain a shift register formed from a chain of register circuits. Each register circuit may supply horizontal control signals (e.g., switching transistor control signals, emission enable signals, etc.) to a corresponding row of pixels. During operation, control circuitry 16 may initiate propagation of a control pulse through the shift register. As the control pulse propagates through the shift register, each gate line G may be activated in sequence, allowing successive rows of pixels 22 to be loaded with data from data lines D. Each register circuit may be referred to as a stage of the shift register.

Figure 5:
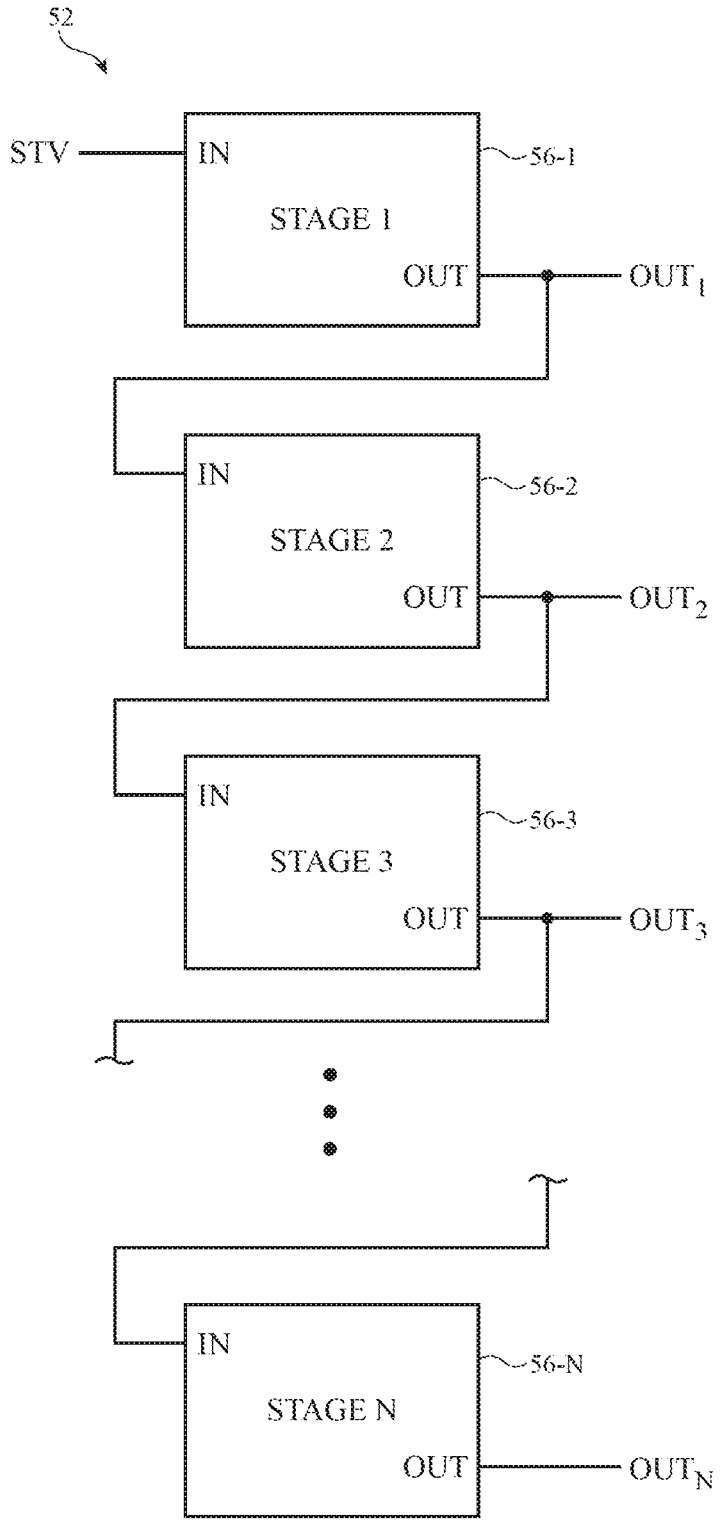
FIG. 5 is a schematic diagram of an illustrative shift register that may be used to form a gate driver or an emission driver for a display in accordance with an embodiment.

FIG. 5 is a schematic diagram of a shift register that may be used to form a gate driver such as gate driver 52 in FIG. 4. The shift register may include a chain of register circuits 56. Each register circuit may supply a horizontal control signal to a corresponding row of pixels. For example, a first register circuit 56-1 may have an output $OUT_1$ that is coupled to the first row of pixels in the display. The second register circuit 56-2 may have an output $OUT_2$ that is coupled to the second row of pixels in the display. The third register circuit 56-3 may have an output OUTS that is coupled to the third row of pixels in the display. This pattern may continue until the last row of the display. Register circuit 56-N may be associated with the last row of pixels in the active area and may have an output $OUT_N$ that is coupled to the last row of pixels in the display.

The first stage (56-1) of the shift register may receive a control pulse (STV) at the input of the first stage. The output of each stage in the shift register may be coupled to the input of the subsequent stage, allowing the control pulse to be propagated through the shift register. For example, the control pulse STV may be provided to the first stage 56-1. This may activate the output of stage 56-1. The output of 56-1 is coupled to the input of stage 56-2, so when the output of 56-1 is activated, the input of 56-2 may be activated. The output of stage 56-2 may be coupled to the input of 56-3, and this pattern may be continued such that the control pulse STV may be propagated through the shift register to activate the output of each register circuit.

Figure 6:
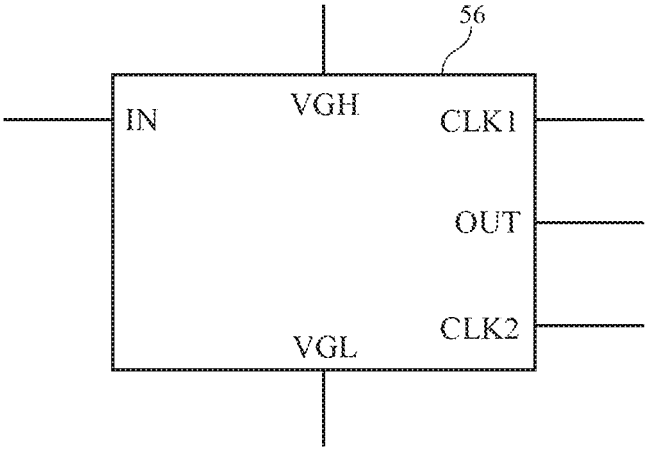
FIG. 6 is a schematic diagram of an illustrative register circuit that may be used in the shift register of FIG. 5 in accordance with an embodiment.

For simplicity, each register circuit in FIG. 5 is depicted as having a single input and a single output. However, each register circuit may have additional inputs and/or outputs as shown in FIG. 6. FIG. 6 shows a detailed view of a register circuit that may be used to form a shift register for gate driver 52 or emission driver 54. The register circuit may include an input (IN) and an output (OUT). The input may be the output from the previous register circuit. The input of the first register circuit may be control pulse STV. The register circuit may also receive clock signals CLK1 and CLK2. Finally, each register circuit may receive first and second supply voltages VGH and VGL.

The shift register structure shown in FIGS. 5 and 6 was described as forming a gate driver (e.g., gate driver 52 in FIG. 4). However, this type of structure may also be used to form an emission driver (e.g., emission driver 54 in FIG. 4). Instead of control pulse STV, the first stage of a shift register for emission driver 54 may receive an emission enable control pulse EMSTV. The output of the register circuits of gate driver 52 shown in FIG. 5 may be provided as control signals GW or GI to pixels 22, while the output of the register circuits of an emission driver 54 may be provided as emission enable control signal EM to pixels 22.

Figure 7:
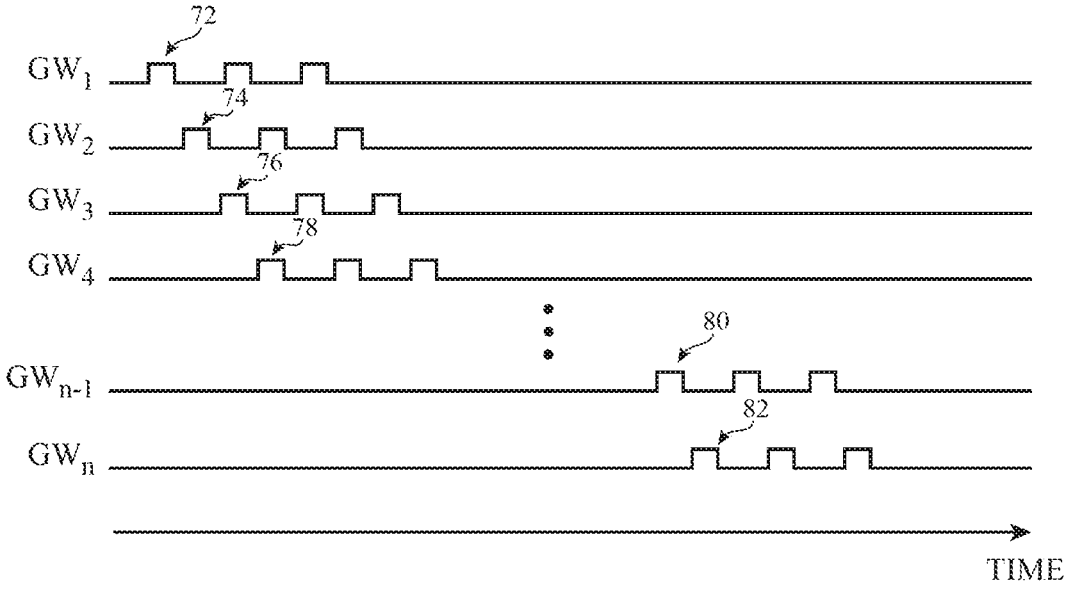
FIG. 7 is a timing diagram showing how a shift register that forms a gate driver for a display may assert various control signals in accordance with an embodiment.
Figure 8:
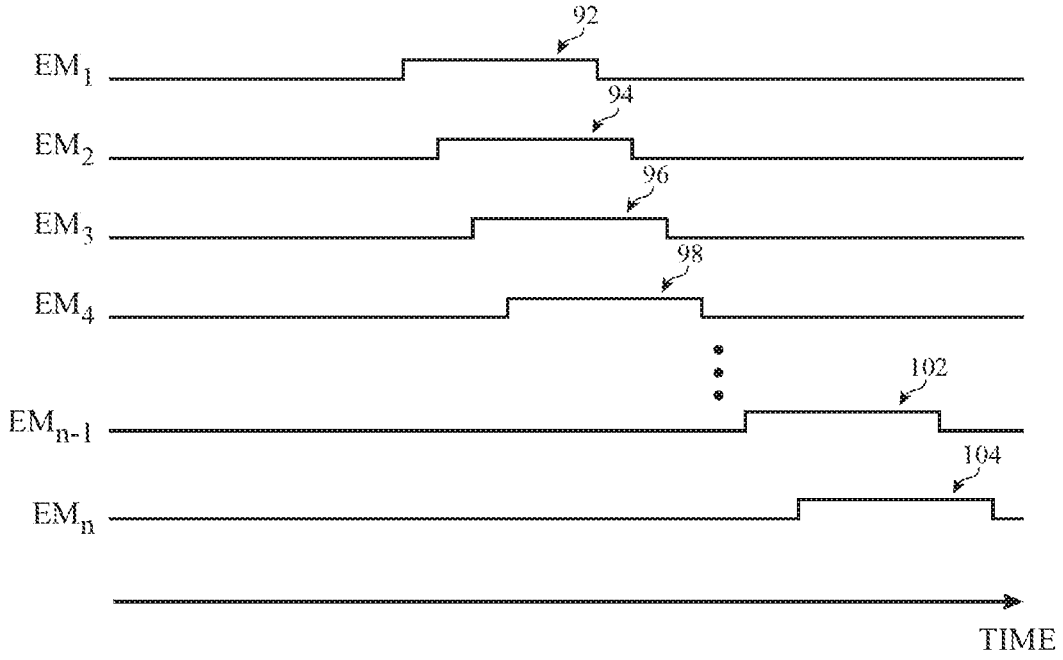
FIG. 8 is a timing diagram showing how a shift register that forms an emission driver for a display may assert various control signals in accordance with an embodiment.

FIGS. 7 and 8 are timing diagrams illustrating how the shift register shown in FIG. 5 may result in a propagation of a control signal through each row in the display. FIG. 7 shows signals that may be output from a gate driver such as gate driver 52 in a normal scanning mode. The output signals may be supplied to each pixel as control signal GW, for example. As shown in FIG. 7, the first control signal $GW_1$ may be asserted at assertion 72. This may result in the control signal $GW_2$ being asserted at assertion 74. Control signal $GW_3$ may subsequently be asserted at assertion 76, and control signal $GW_4$ may subsequently be asserted at assertion 78. The propagation of assertions 72, 74, 76, and 78 may be caused by the setup of the shift register that forms gate driver 52. The signal may continue through the shift register until the end of the display. Control signal $GW_{N-1}$ (i.e., the control signal of the second to last row in the display) may be asserted at assertion 80, which may cause the assertion of control signal $GW_N$ (i.e., the control signal of the last row in the display) at assertion 82. FIG. 7 shows that each control signal is asserted three times in sequence. This type of scheme may be used if desired (i.e., for initialization and loading). However, this example is merely illustrative and each control signal may be asserted only once, twice, more than three times, or any other desired number of times.

FIG. 8 shows signals that may be output from an emission driver such as emission driver 54 in a normal scanning mode. The output signals may be supplied to each pixel as emission enable control signal EM. As shown in FIG. 8, the first emission enable control signal $EM_1$ may be asserted at assertion 92. This may result in the emission enable control signal $EM_2$ being asserted at assertion 94. Emission enable control signal $EM_3$ may subsequently be asserted at assertion 96, and emission enable control signal $GW_4$ may subsequently be asserted at assertion 98. The propagation of assertions 92, 94, 96, and 98 may be caused by the setup of the shift register that forms emission driver 54. The signal may continue through the shift register until the end of the display. Emission enable control signal $EM_{N-1}$ (i.e., the emission enable control signal of the second to last row in the display) may be asserted at assertion 100, which may cause the assertion of emission enable control signal $EM_N$ (i.e., the emission enable control signal of the last row in the display) at assertion 102.

In the embodiment shown in FIGS. 7 and 8, every row in the display is scanned during each frame. This may be suitable for normal operation of the display (i.e., a normal scanning mode). However, in some instances, it may be desirable to scan only some of the rows in the display (i.e., a partial scanning mode). For example, the display may be operable in a high refresh rate. During normal operation, the refresh rate of the display may be approximately 60 Hz. During a high refresh rate mode, the refresh rate of the display may be greater than 60 Hz (i.e., 75 Hz, 90 Hz, 96 Hz, 120 Hz, etc.). As the refresh rate of the display increases, the amount of time for each row to be scanned decreases. If the scan time for each row is too low, the amount of time for voltage threshold compensation may not be sufficient and the display may have poor uniformity or other visible artifacts. To alleviate this issue, only some of the rows of the display may be scanned when the display operates at a high refresh rate.

In some embodiments, display 14 may be incorporated into a head mounted device, and the images displayed on display 14 may be dependent on the head position of the user in order to create an augmented reality (AR) or virtual reality (VR) environment for the user. In a virtual reality environment, only some of the display may be needed to present images to the user (i.e., a first portion may present images to the user's first eye and a second portion may present images to the user's second eye). Therefore, when a display is operated at a high refresh rate for virtual reality applications, only some of the rows of the display may be scanned to improve performance of the display.

Figure 9:
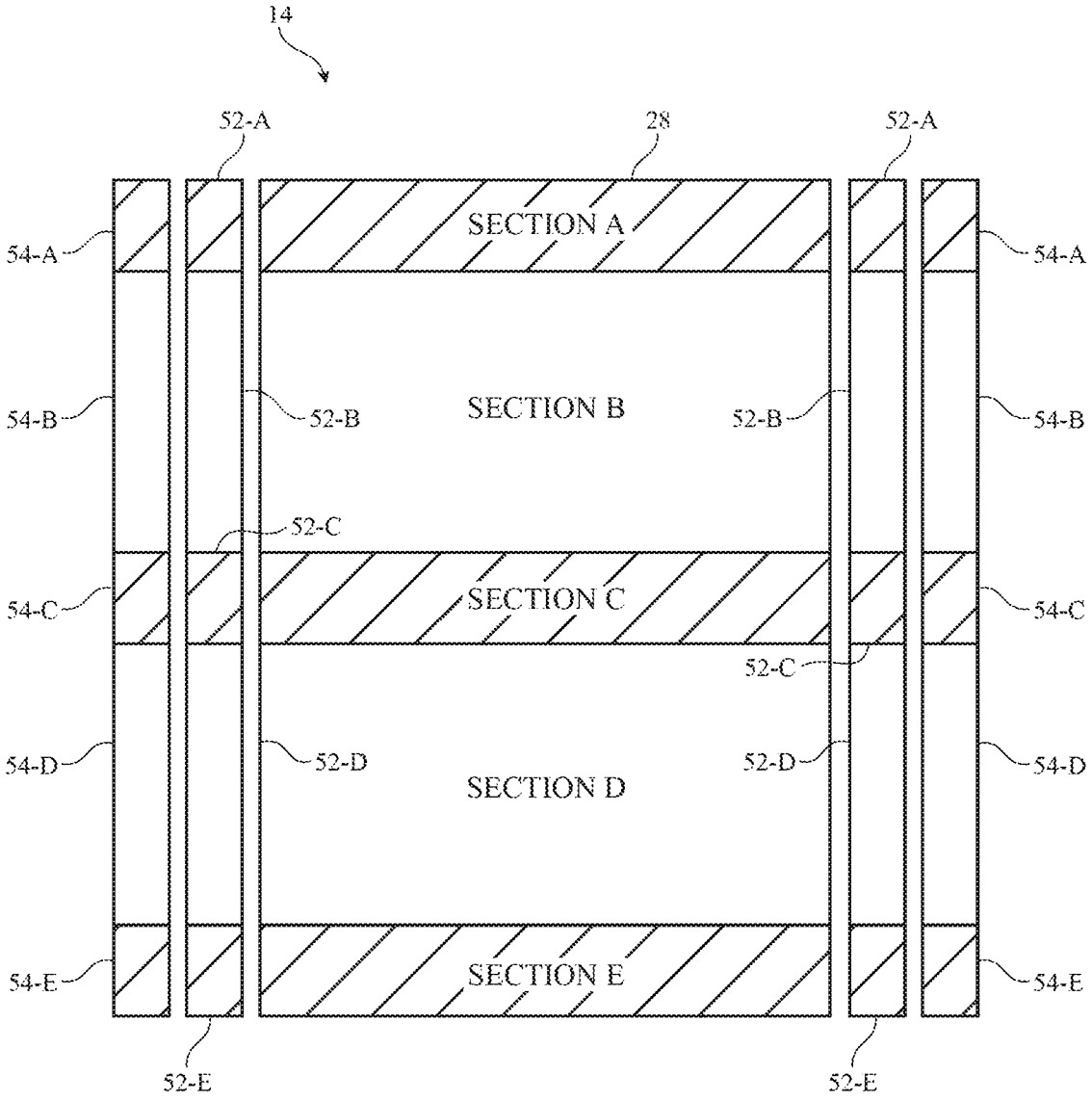
FIG. 9 is a top view of an illustrative display showing how the display may include a gate driver that is split into several portions and an emission driver that is split into several portions in accordance with an embodiment.

FIG. 9 is a top view of an illustrative display that is operable in a normal scanning mode and a partial scanning mode. In the normal scanning mode, every row in the display may be scanned during each frame. In the partial scanning mode, only some rows in the display may be scanned during each frame. The refresh rate of the display may be higher in the partial scanning mode than in the normal scanning mode. To allow the display to operate in two modes, pixel array 28 may be divided into different sections. In the illustrative example shown in FIG. 9, display 14 has been divided into section A, section B, section C, section D, and section E. During the normal scanning mode, the rows of section A, section B, section C, section D, and section E may all be scanned during each frame. However, during the partial scanning mode, only the rows of section B and section D may be scanned during each frame. This means that only section B and section D of the display will be used to display images during partial scanning mode operation. During normal scanning mode operation, section A, section B, section C, section D, and section E may all be used to display images.

Each section of the display may have corresponding gate driver and emission driver portions. Section A may have corresponding gate driver portions 52-A and emission driver portions 54-A, section B may have corresponding gate driver portions 52-B and emission driver portions 54-B, section C may have corresponding gate driver portions 52-C and emission driver portions 54-C, section D may have corresponding gate driver portions 52-D and emission driver portions 54-D, and section E may have corresponding gate driver portions 52-E and emission driver portions 54-E. During normal scanning operation, each gate driver portion may be connected to the subsequent gate driver portion (i.e., gate driver portion 52-A is coupled to gate driver portion 52-B, gate driver portion 52-B is coupled to gate driver portion 52-C, etc.). However, during partial scanning operation, gate driver portion 52-B may be coupled to gate driver portion 52-D. Gate driver portion 52-A, gate driver portion 52-C, and gate driver portion 52-E may not be used to scan rows during partial scanning operation.

The example in FIG. 9 of the display being split into five separate sections is merely illustrative. The display may be split into any desired number of sections, with any desired sections being disabled in the partial scanning mode.

Figure 10A:
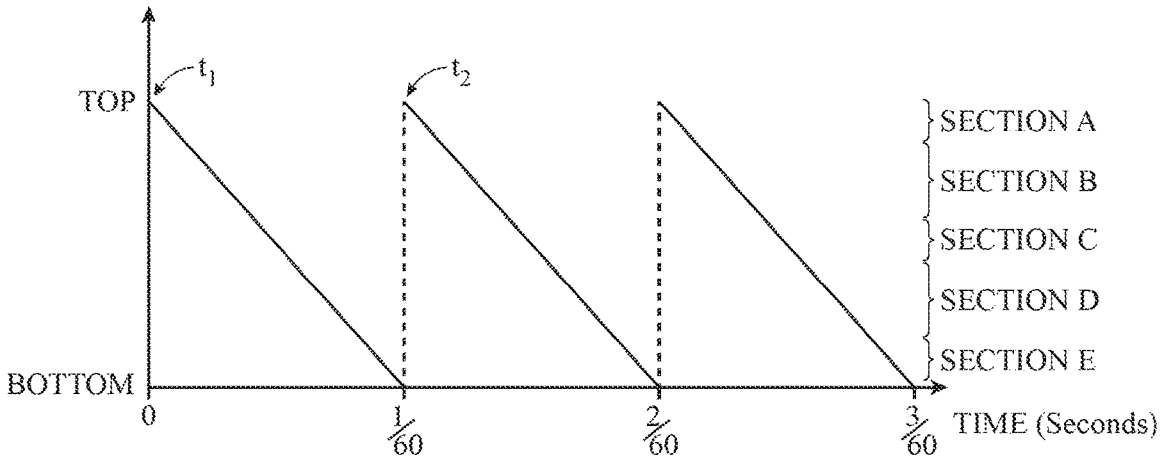
FIG. 10A is a diagram showing the scanning scheme of an illustrative display while the display operates in a normal scanning mode in accordance with an embodiment.
Figure 10B:
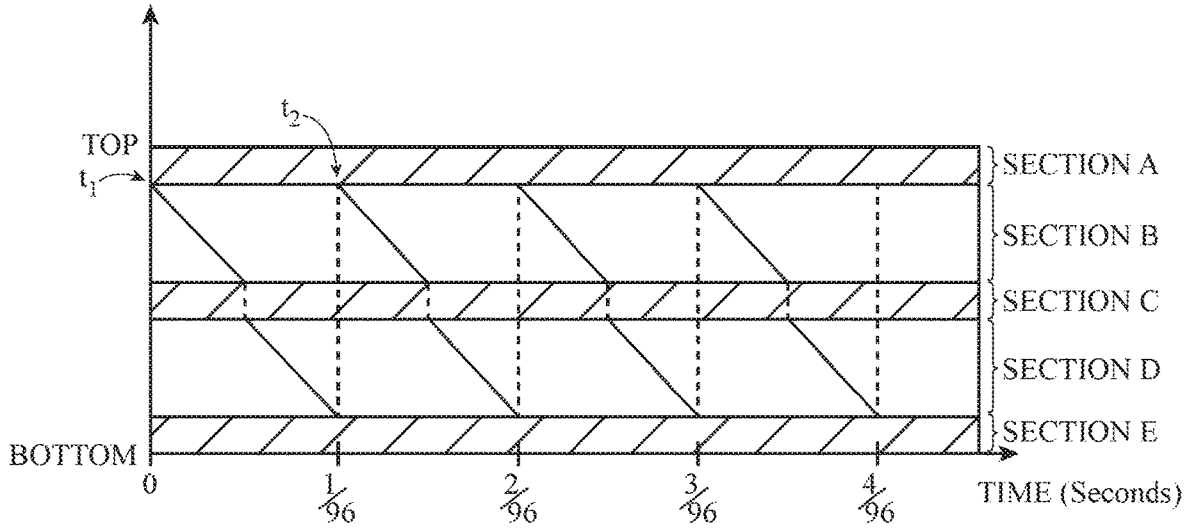
FIG. 10B is a diagram showing the scanning scheme of an illustrative display while the display operates in a partial scanning mode in accordance with an embodiment.

FIGS. 10A and 10B are timing diagrams of an illustrative display operating in a normal scanning mode and a partial scanning mode. FIG. 10A shows the display operating in a normal scanning mode. At $t_1$, the first row of the display (i.e., the row at the top of the active area of the display) may be scanned. Each subsequent row of the display may then be scanned. At the bottom of the display, the last row of the display may be scanned as the frame duration of $1/60^{th}$ of a second elapses. After the last row of the display is scanned at $t_2$, the first row may be scanned again as the second frame begins. All of the rows may be scanned from $1/60^{th}$ of a second until $2/60^{th}$ of a second. This pattern may continue with every row in the display being scanned every $1/60^{th}$ of a second.

In certain situations (i.e., when the display is operating in a virtual reality mode), it may be desirable for the display to have a higher refresh rate. To reduce artifacts and still operate at a high refresh rate, the display may optionally operate in a partial scanning mode. FIG. 10B shows the display operating in a partial scanning mode. At $t_1$, the first row of section B of the display may be scanned. Each subsequent row of section B of the display may then be scanned. After the last row in section B is scanned, the first row of section D may be scanned. At the bottom of section D, the last row of section D may be scanned as the frame duration of $1/96^{th}$ of a second elapses. After the last row in section D is scanned at $t_2$, the first row of section B may be scanned again as the second frame begins. The rows in section B and section D may be scanned again from $1/96^{th}$ of a second until $2/96^{th}$ of a second. This pattern may continue with every frame in section B and section D of the display being scanned every $1/96^{th}$ of a second. The rows of section A, section C, and section E may not be scanned or emit light when the display operates in the partial scanning mode.

The examples of frame durations shown in FIGS. 10A and 10B (i.e., 60 Hz for the normal scanning mode of FIG. 10A and 96 Hz for the partial scanning mode of FIG. 10B) are merely illustrative. In general, the display may operate at any desired refresh rate during the normal scanning mode and at any desired refresh rate during the partial scanning mode. However, during the normal scanning mode all of the rows of the display may be scanned whereas during the partial scanning mode only some of the rows of the display may be scanned.

Figure 11:
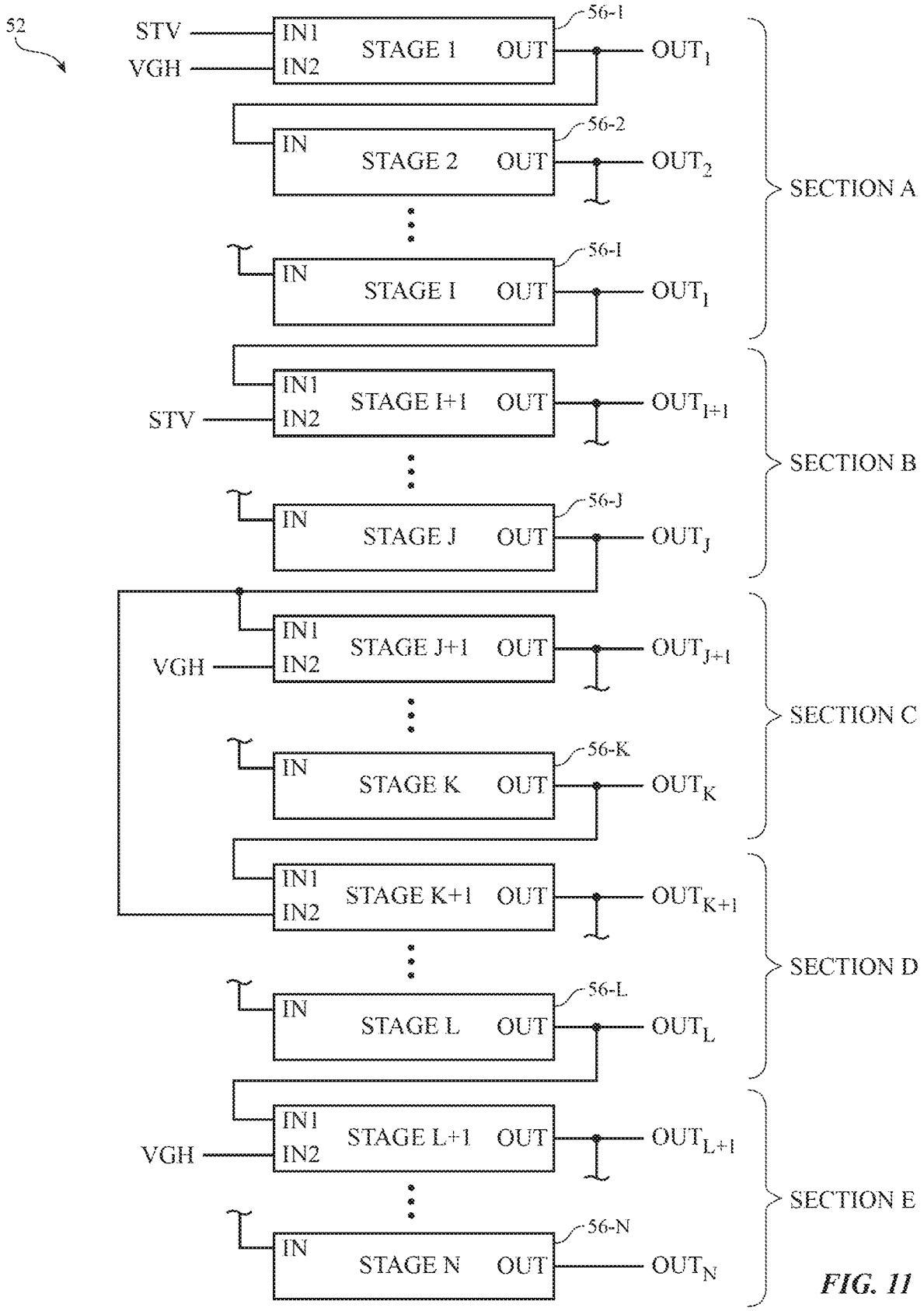
FIG. 11 is a schematic diagram of an illustrative shift register that may be used to form a gate driver or an emission driver for a display that can operate in a normal scanning mode and a partial scanning mode in accordance with an embodiment.

FIG. 11 is a schematic diagram of a shift register that may be used to form a gate driver for a display with a normal scanning mode and a partial scanning mode. The shift register may include a chain of register circuits 56. Each register circuit may supply a horizontal control signal to a corresponding row of pixels. For example, a first register circuit 56-1 may have an output $OUT_1$ that is coupled to the first row of pixels in the display. The second register circuit 56-2 may have an output $OUT_2$ that is coupled to the second row of pixels in the display. The $I^{th}$ register circuit 56-I may have an output $OUT_1$ that is coupled to the $I^{th}$ row of pixels in the display. This pattern may continue until the last row of the display. Register circuit 56-N may be associated with the last row of pixels in the active area and may have an output $OUT_N$ that is coupled to the last row of pixels in the display.

As discussed in connection with FIG. 9, gate driver 52 may have different portions (section A, section B, section C, section D, and section E). Section A of gate driver 52 may include stages 1, 2, . . . , and I of the shift register. Section B of gate driver 52 may include stages I+1, . . . , and J of the shift register. Section C of gate driver 52 may include stages J+1, . . . , and K of the shift register. Section D of gate driver 52 may include stages K+1, . . . , and L of the shift register. Section E of gate driver 52 may include stages L+1, . . . , and N of the shift register. Each stage of the shift register may be coupled to the subsequent stage. For example, the last stage of section A (stage I) may be coupled to the first stage of section B (stage I+1), the last stage of section B (stage J) may be coupled to the first stage of section C (stage J+1), the last stage of section C (stage K) may be coupled to the first stage of section D (stage K+1), and the last stage of section D (stage L) may be coupled to the first stage of section E (stage L+1).

In order to allow the display to operate in two modes, some of the register circuits may have two inputs. In particular, the first stage of each section may have two inputs. The first stage (56-1) of section A may have a first input (IN1) that receives a control pulse (STV). The first stage of section A may have a second input (IN2) that receives supply voltage VGH. The first stage (stage I+1) of section B may have a first input (IN1) that receives the output from the last stage of section A (stage I). The first stage of section B may have a second input (IN2) that receives a control pulse (STV). The first stage (stage J+1) of section C may have a first input (IN1) that receives the output from the last stage of section B (stage J). The first stage of section C may have a second input (IN2) that receives supply voltage VGH. The first stage (stage K+1) of section D may have a first input (IN1) that receives the output from the last stage of section C (stage K). The first stage of section D may have a second input (IN2) that receives the output from the last stage of section B (stage J). The first stage (stage L+1) of section E may have a first input (IN1) that receives the output from the last stage of section D (stage L). The first stage of section E may have a second input (IN2) that receives supply voltage VGH.

When the display is operating in the normal mode, the first stage of each section (i.e., stage 1, stage I+1, stage J+1, stage K+1, and stage L+1) may respond to the first input (IN1). Accordingly, in the normal mode stage 1 may receive control pulse STV and propagate the control pulse throughout the shift register in the normal mode. The control pulse will be passed from the last stage of section A (stage I) to the first stage of section B (stage I+1), from the last stage of section B (stage J) to the first stage of section C (stage J+1), from the last stage of section C (stage K) to the first stage of section D (stage K+1), and from the last stage of section D (stage L) to the first stage of section E (stage L+1).

When the display is operating in the partial mode, the first stage of each section (i.e., stage 1, stage I+1, stage J+1, stage K+1, and stage L+1) may respond to the second input (IN2). This means that stage 1, stage J+1, and stage L+1 will all receive supply voltage VGH, ensuring that sections A, C, and E of the gate driver will not be used. Stage I+1 may receive control pulse STV and propagate the control pulse throughout the register circuits of section B and section D. The control pulse will be passed from the last stage of section B (stage J) to the first stage of section D (stage K+1). This way, only the rows in section B and section D of the display will be addressed.

Figure 12:
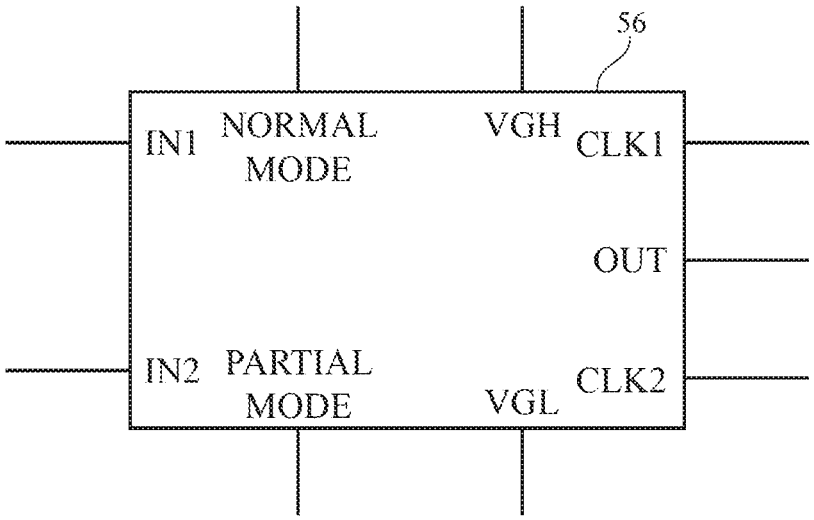
FIG. 12 is a schematic diagram of an illustrative register circuit that may be used in the shift register of FIG. 11 in accordance with an embodiment.

For simplicity, each register circuit in FIG. 11 is depicted as having either one or two inputs and a single output. However, each register circuit may have additional inputs and/or outputs as shown in FIG. 12. FIG. 12 shows a detailed view of a register circuit that may be used to form a shift register for gate driver 52 or emission driver 54. The register circuit may include a first input (IN1), a second input (IN2), and an output (OUT). The register circuit may also receive clock signals CLK1 and CLK2. Each register circuit may receive first and second supply voltages VGH and VGL. In addition, the register circuit may receive additional control signals used to determine whether or not the display is operating in the normal mode or the partial mode. The register circuit may receive a normal mode signal and a partial mode signal. If the normal mode signal is asserted at a logic high level, the register circuit may use input 1 and operate in the normal mode. If the partial mode signal is asserted at a logic high level, the register circuit may use input 2 and operate in the partial mode. The first stage of each section in the display (i.e., stage 1, stage I+1, stage J+1, stage K+1, and stage L+1, may be register circuits of the type shown in FIG. 12. The last stage of each section in the display (i.e., stage I, stage J, stage K, stage L, and stage N) and the stages in between the first and last stages in each section may be register circuits of the type shown in FIG. 6 (i.e., with only one input instead of two).

The shift register structure shown in FIGS. 11 and 12 was described as forming a gate driver (e.g., gate driver 52 in FIG. 9). However, this type of structure may also be used to form an emission driver (e.g., emission driver 54 in FIG. 9). Instead of control pulse STV, one or more stages of a shift register for emission driver 54 may receive an emission control pulse EMSTV. The output of the register circuits of gate driver 52 shown in FIG. 9 may be provided as control signals GW or GI to pixels 22, while the output of the register circuits of an emission driver 54 may be provided as emission enable control signal EM to pixels 22.

In some embodiments, additional transistors may be included in the shift register of the display (i.e., the shift register of FIG. 11) to select one of the two input signals. For example, stage 1 of the shift register may include an input node to which IN1 and IN2 are coupled. A first transistor may be asserted to couple IN1 to the input node, or a second transistor may be asserted to couple IN2 to the input node. The second transistor may be deasserted while the first transistor is asserted, and the first transistor may be deasserted while the second transistor is asserted. The first and second transistors may be controlled by the normal mode signal and the partial mode signal shown in FIG. 12, for example. The shift register for both gate driver 52 and emission driver 54 may both receive the normal mode signal and the partial mode signal. The normal mode signal and the partial mode signal may be globally controlled. Any other desired components may be used (i.e., a switch) by the shift register to select one of two or more inputs to be used by a register circuit.

If desired, additional enable signals may be included to provide further control in the partial scanning mode. In some embodiments, the gate driver may have an additional stage compared to the emission driver. The gate driver may have an initialization stage that is not associated with a row of display pixels. During normal scanning mode operation, the initialization stage of the gate driver may receive a control pulse and the first stage of the emission driver (that is associated with the first row of display pixels) may receive an emission enable control pulse. During the partial scanning mode, the emission enable control pulse may be provided to the first stage of the section of the display that is enabled (i.e., stage I+1 as shown in FIG. 11). However, the control pulse for the gate driver may be provided to the last stage of the first section that is disabled (i.e., the control pulse would be provided to stage I in FIG. 11 instead of stage I+1). This allows the last stage of disabled section to act as the initialization stage for the enabled section of the display.

Several of the aforementioned embodiments have described gate driver circuitry for a light-emitting diode display. It should be noted that similar concepts may be used in a liquid crystal display. For example, a liquid crystal display may have gate driver circuitry that includes a shift register. The shift register may be operable in a normal scanning mode in which all of the rows in the display are scanned or a partial scanning mode in which only some of the rows in the display are scanned. In general, any desired type of display may be configured to operate in a partial scanning mode and a normal scanning mode.

In various embodiments, a display may include an array of pixels formed in an active area of the display that includes rows and columns of pixels, display driver circuitry formed in an inactive area of the display that is configured to provide image data to the pixels, and gate driver circuitry formed in the inactive area of the display. The gate driver circuitry may include a shift register that includes a plurality of register circuits, each register circuit may have at least one output that is provided to a corresponding row of pixels, at least one register circuit in the shift register may have a first input and a second input that is different than the first input, the first input may be used when the display operates in a first mode, and the second input may be used when the display operates in a second mode.

The first input may be a control pulse and the second input may be a supply voltage. The at least one register circuit may include a first register circuit. The first input of the first register circuit may be an output of a second register circuit that is directly adjacent to the first register circuit and the second input of the first register circuit may be a control pulse. The first input of the first register circuit may be an output of a second register circuit that is directly adjacent to the first register circuit and the second input of the first register circuit may be an output of a third register circuit that is not directly adjacent to the first register circuit. The first input of the first register circuit may be an output of a second register circuit that is directly adjacent to the first register circuit and the second input of the first register circuit may be a supply voltage.

The display may have a total number of rows of pixel, the shift register may scan every row in the array of pixels when the display operates in the first mode, and the shift register may scan only a given number of rows that is less than the total number of rows when the display operates in the second mode. The first mode may be a normal scanning mode in which every row of pixels in the display is scanned. The second mode may be a partial scanning mode in which only a subset of rows of pixels in the display are scanned. The display may have a first refresh rate in the normal scanning mode and a second refresh rate in the partial scanning mode and the second refresh rate may be higher than the first refresh rate.

In various embodiments, a display may include a plurality of display pixels arranged in rows and columns, display driver circuitry configured to provide image data for a frame to the display pixels, and gate driver circuitry. The gate driver circuitry may include a shift register configured to scan rows of display pixels by asserting gate line signals in sequence, the shift register may be configured to operate in a normal scanning mode in which every row of display pixels is scanned in each frame, and the shift register may be configured to operate in a partial scanning mode in which only a subset of the rows of display pixels are scanned in each frame.

The shift register may include a plurality of register circuits and at least one register circuit may receive a partial mode control signal and a normal mode control signal. The shift register may be configured to operate in the normal scanning mode when the normal mode control signal is asserted and the shift register may be configured to operate in the partial scanning mode when the partial mode control signal is asserted. The at least one register circuit may be coupled to a first input and a second input, the at least one register circuit may use the first input when the normal mode control signal is asserted, and the at least one register circuit may use the second input when the partial mode control signal is asserted. The at least one register circuit may include a first register circuit, the first input of the first register circuit may be an output of a second register circuit that is directly adjacent to the first register circuit, and the second input of the first register circuit may be an output of a third register circuit that is not directly adjacent to the first register circuit.

In various embodiments, a display configured to operate in a first mode and a second mode may include an active area with display pixels that has a first portion and a second portion and gate driver circuitry. The gate driver circuitry may be configured to address the first and second portions of the active area when the display operates in the first mode and the gate driver circuitry may be configured to address only the first portion of the active area when the display operates in the second mode.

The gate driver circuitry may include a shift register with a plurality of register circuits. The active area may include a first section at the top of the active area, a second section at the bottom of the active area, and a third section interposed between the first section and the second section. The first, second, and third sections of the active area may form the second portion of the active area. The active area may also include a fourth section that is interposed between the first section and the third section and a fifth section that is interposed between the second section and the third section. The fourth and fifth sections may form the first portion of the active area. The shift register may have a first plurality of register circuits that correspond to the first section of the display, a second plurality of register circuits that correspond to the second section of the display, a third plurality of register circuits that correspond to the third section of the display, a fourth plurality of register circuits that correspond to the fourth section of the display, and a fifth plurality of register circuits that correspond to the fifth section of the display. The first register circuit in the first plurality of register circuits may have a first input and a second input, the first register circuit in the second plurality of register circuits may have a third input and a fourth input, the first register circuit in the third plurality of register circuits may have a fifth input and a sixth input, the first register circuit in the fourth plurality of register circuits may have a seventh input and an eighth input, and the first register circuit in the fifth plurality of register circuits may have a ninth input and a tenth input.

The first input may be a control pulse, the second input may be a supply voltage, the third input may be an output of a register circuit that is directly adjacent to the first register circuit of the second plurality of register circuits, the fourth input may be a supply voltage, the fifth input may be an output of a register circuit that is directly adjacent to the first register circuit of the third plurality of register circuits, the sixth input may be a supply voltage, the seventh input may be an output of a register circuit that is directly adjacent to the first register circuit of the fourth plurality of register circuits, the eighth input may be a control pulse, the ninth input may be an output of a register circuit that is directly adjacent to the first register circuit of the fifth plurality of register circuits, and the tenth input may be an output of a register circuit that is not directly adjacent to the first register circuit of the fifth plurality of register circuits.

As previously mentioned, the example in FIG. 9 of the display being split into five separate sections is merely illustrative. The display may be split into any desired number of sections, with any desired sections being disabled in the partial scanning mode. For example, in FIG. 13 the display is split into three separate sections with two sections being disabled in the partial scanning mode.

Figure 13:
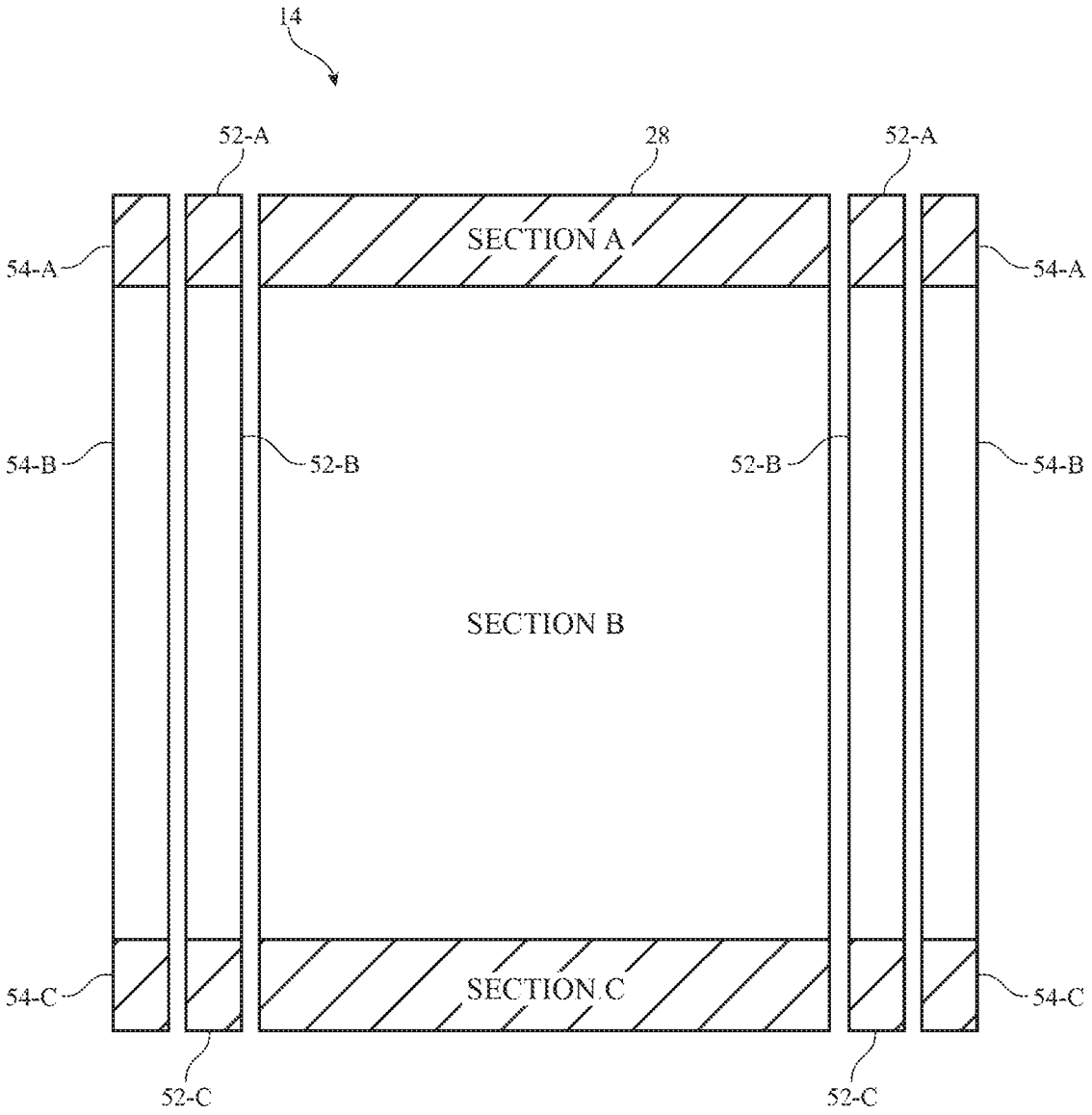
FIG. 13 is a top view of an illustrative display showing how the display may include a gate driver that is split into several portions and an emission driver that is split into several portions in accordance with an embodiment.

FIG. 13 is a top view of an illustrative display that is operable in a normal scanning mode and a partial scanning mode. In the normal scanning mode, every row in the display may be scanned during each frame. In the partial scanning mode, only some rows in the display may be scanned during each frame. The refresh rate of the display may be higher in the partial scanning mode than in the normal scanning mode. To allow the display to operate in two modes, pixel array 28 may be divided into different sections. In the illustrative example shown in FIG. 13, display 14 has been divided into section A, section B, and section C. During the normal scanning mode, the rows of section A, section B, and section C may all be used to display images. However, during the partial scanning mode, only the rows of section B may be used to display images.

Each section of the display may have corresponding gate driver and emission driver portions. Section A may have corresponding gate driver portions 52-A and emission driver portions 54-A, section B may have corresponding gate driver portions 52-B and emission driver portions 54-B, and section C may have corresponding gate driver portions 52-C and emission driver portions 54-C. During normal scanning operation, each gate driver portion may be connected to the subsequent gate driver portion (i.e., gate driver portion 52-A is coupled to gate driver portion 52-B, gate driver portion 52-B is coupled to gate driver portion 52-C, etc.). However, during partial scanning operation, gate driver portion 52-A and gate driver portion 52-C may not be used to scan rows for display or may have a different scanning scheme than in the normal mode. Similarly, during normal scanning operation, each emission driver portion may be connected to the subsequent emission driver portion (i.e., emission driver portion 54-A is coupled to emission driver portion 54-B, emission driver portion 54-B is coupled to emission driver portion 54-C, etc.). However, during partial scanning operation, emission driver portion 54-A and emission driver portion 54-C may not be used to display images.

Figures 14A, 14B, 14C, 14D:
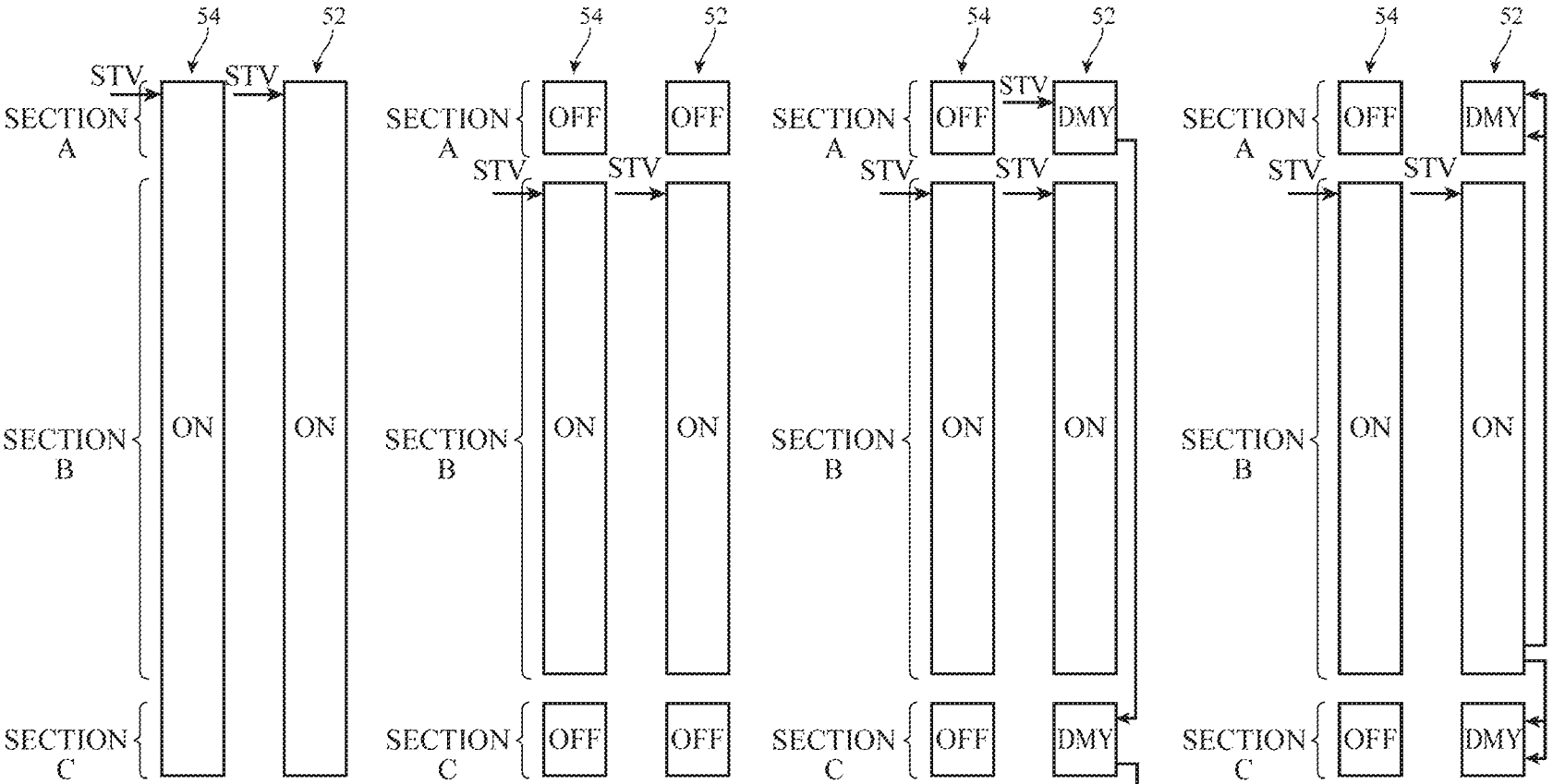
FIGS. 14A-14D are diagrams showing driving sequences for illustrative emission drivers and scan drivers that are operable in a partial scanning mode in accordance with an embodiment.

FIGS. 14A-14D are diagrams showing driving sequences for illustrative emission drivers and scan drivers that are operable in a partial scanning mode. FIG. 14A shows a diagram of illustrative emission drivers and scan drivers during a normal scanning mode. During the normal scanning mode the first row of emission driver 54 and scan driver 52 receive a control pulse (STV). As all of the rows in the display are on in the normal scanning mode, the control pulse is propagated throughout the entire display (as shown in connection with FIG. 5, for example). The last register circuit of section A may pass the control pulse to the first register circuit of section B. After the control pulse is propagated through section B, the last register circuit of section A may pass the control pulse to the first register circuit of section C.

FIG. 14B shows a diagram of an illustrative emission driver and an illustrative gate driver during a partial scanning mode. During the partial scanning mode, control pulse STV may be provided directly to section B of emission driver 54 and scan driver 52. Section A and section C of emission driver 54 may be turned off in the partial scanning mode to ensure the rows of the disabled sections do not display images. Similarly, section A and section C of the scan driver may be turned off in the partial scanning mode.

By selectively disabling sections of the display during the partial scanning mode, display performance may be improved and power may be conserved. However, the display sections that are disabled during the partial scanning mode may experience less thin film transistor (TFT) stress than the display sections that are not disabled during the partial scanning mode. Over time, this imbalance in TFT stress may cause visible artifacts in the display. To equalize the amount of permanent TFT stress in each section of the display, the scan driver of the sections that are disabled during the partial scanning mode may still scan the disabled rows during the partial scanning mode (even though the disabled rows do not display images). FIGS. 14C and 14D are diagrams of illustrative emission and scan drivers in partial scanning modes where the disabled rows are still scanned by the scan driver.

As shown in FIG. 14C, in the partial scanning mode a control pulse STV may be provided directly to section B of emission driver 54 and scan driver 52. Section A and section C of emission driver 54 may be turned off in the partial scanning mode to ensure the rows of the disabled sections do not display images. However, to equalize the amount of permanent TFT stress between sections A and C (which are disabled during the partial scanning mode) and section B (which is enabled during the partial scanning mode), scan driver 52 may scan the rows of section A and section C in the partial scanning mode. As shown in FIG. 14C, in addition to a control pulse being provided to section B, a control pulse (STV) may also be provided to section A. The signal may be propagated through register circuits of section A of scan driver 52. The signal may be passed from the last register circuit of section A to the first register circuit of section C. Using this drive sequence ensures that all of the rows in the display are scanned once during each frame, equalizing the TFT stress across the display. The rows of sections A and C that are scanned but not used to display images may sometimes be referred to as dummy rows (labeled "DMY").

To optimize the driving sequence, the display may include additional rows below the active area of the display (sometimes referred to as "dummy rows") that do not display images. The dummy rows below the active area may be considered in the inactive area of the display and may not display images in the normal scanning mode or the partial scanning mode. During the partial scanning mode, the control signal may be passed from the last register circuit of section C to the first register circuit of the dummy rows. The signal may then be propagated through the register circuits of the dummy rows. When the control signal reaches the last register circuit of the dummy rows, the control signal may be directed to the first register circuit of the dummy rows. In this way, the control signal may be cycled through the dummy rows for the duration of the frame to prevent a sudden change in loading for the rows in the enabled area. There may be any desired number of rows in the inactive area that do not display images in the partial or normal scanning modes (e.g., less than four rows, four rows, more than four rows, six rows, etc.).

FIG. 14D shows an alternate embodiment of a scan driver that scans disabled rows during a partial scanning mode. As shown in FIG. 14D, in the partial scanning mode a control pulse STV may be provided directly to section B of emission driver 54 and scan driver 52. Section A and section C of emission driver 54 may be turned off in the partial scanning mode to ensure the rows of the disabled sections do not display images. However, to equalize the amount of permanent TFT stress between sections A and C (which are disabled during the partial scanning mode) and section B (which is enabled during the partial scanning mode), scan driver 52 may scan the rows of section A and section C in the partial scanning mode. As shown, the control pulse STV may be provided to section B of scan driver 52 and then be propagated through the register circuits of section B of the scan driver. After the signal reaches the last register circuit in section B, the signal may be passed to the first register circuits of section A and section C. The rows of sections A and C may then be scanned during the vertical blanking period of the frame.

In order to scan all of the rows in the disabled sections during the vertical blanking period (which may be a short duration of time), the control signal may be passed in parallel to numerous rows in the disabled sections. In one illustrative example, the control signal could be passed from the last register circuit of section B to the first register circuit of section A. Simultaneously, the control signal could be passed from the last register circuit of section B to the first register circuit of section C. The control signal may be provided to additional rows in parallel with the first rows of sections A and C. In general, the control signal may be provided to any desired number of rows in parallel to ensure that all of the disabled rows are scanned during the vertical blanking period of the frame.

Figure 15:
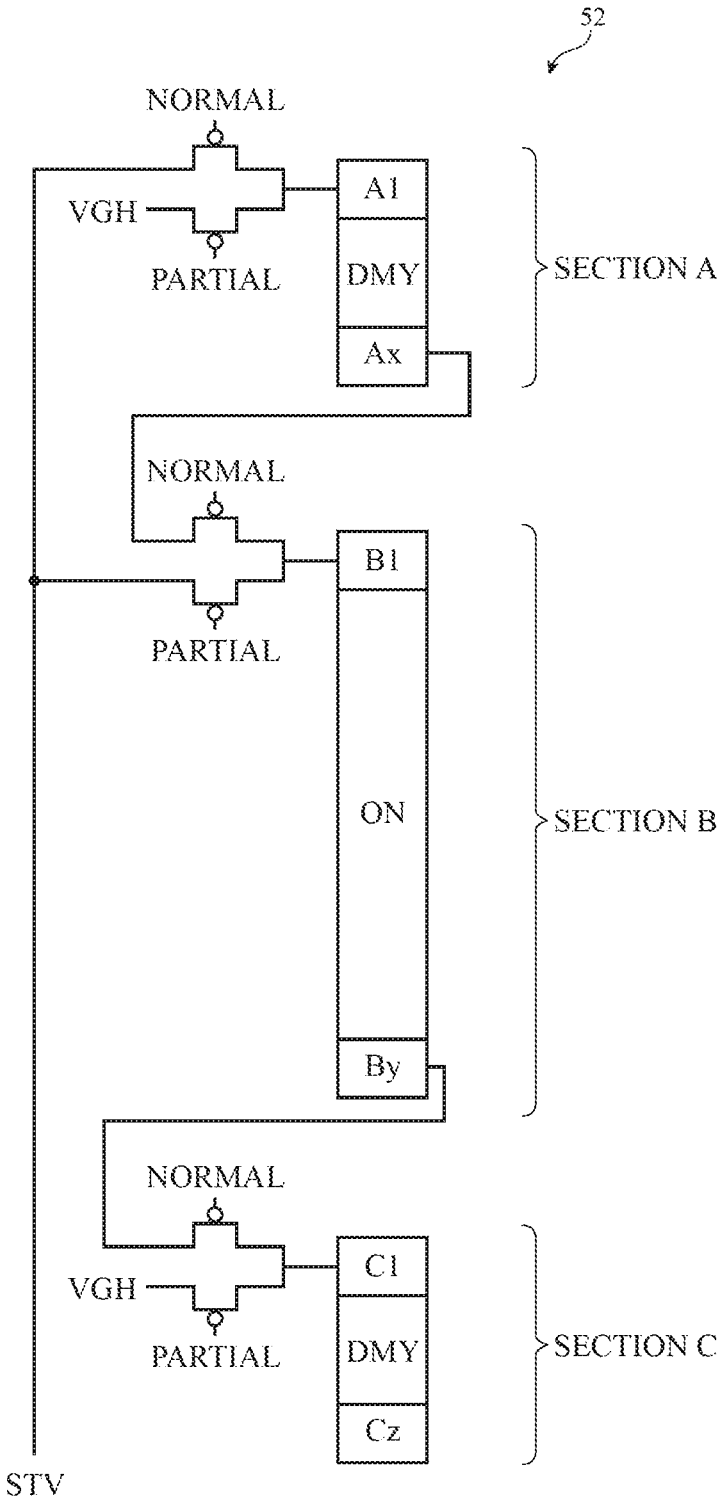
FIG. 15 is a diagram of an illustrative scan driver that does not scan disabled rows of the display in the partial scanning mode in accordance with an embodiment.

FIG. 15 is a diagram of an illustrative scan driver that does not scan disabled rows of the display in a partial scanning mode. As shown in FIG. 15, scan driver 52 may include sections A, B, and C. Section A may have a register circuit A1 associated with the first row of section A and a register circuit Ax associated with the last row of section A. Section B may have a register circuit B1 associated with the first row of section B and a register circuit By associated with the last row of section B. Section C may have a register circuit C1 associated with the first row of section C and a register circuit Cz associated with the last row of section C. Scan driver 52 of FIG. 15 may be operable in a normal scanning mode in which all of the rows in the display are used to display an image and a partial scanning mode in which only some of the rows in the display are used to display an image. When in the normal scanning mode, the "NORMAL" signal may be asserted, whereas when in the partial scanning mode, the "PARTIAL" signal may be asserted. The NORMAL and PARTIAL signals may control the drive sequence used by the scan driver.

As shown in FIG. 15, when scan driver 52 is in the normal scanning mode, a control pulse STV will be provided to register circuit A1 of section A. After propagating through the register circuits of section A, the control signal will be passed from the last register circuit of section A (Ax) to the first register circuit of section B (B1). After propagating through the register circuits of section B, the control signal will be passed from the last register circuit of section B (By) to the first register circuit of section C (C1). When scan driver 52 is in the partial scanning mode, control pulse STV will be provided to register circuit B1 of section B and be propagated through section B. Section A and section C of the scan driver will be disabled during the partial scanning mode, and the rows of section A and section C will not be scanned during the partial scanning mode.

Figure 16:
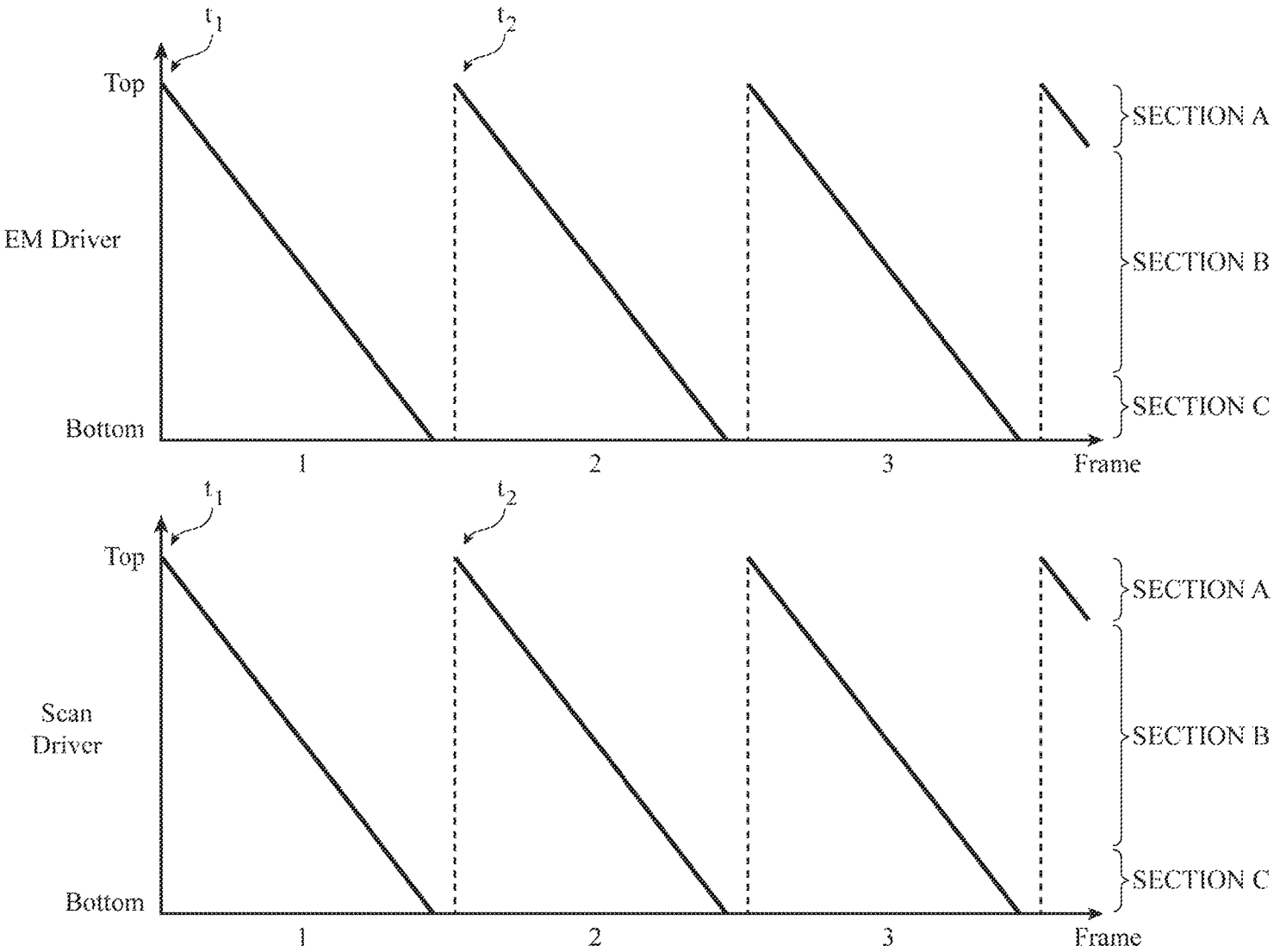
FIG. 16 is a diagram showing the scanning scheme of an illustrative display while the display operates in a normal scanning mode using the scan driver of FIG. 15 in accordance with an embodiment.
Figure 17:
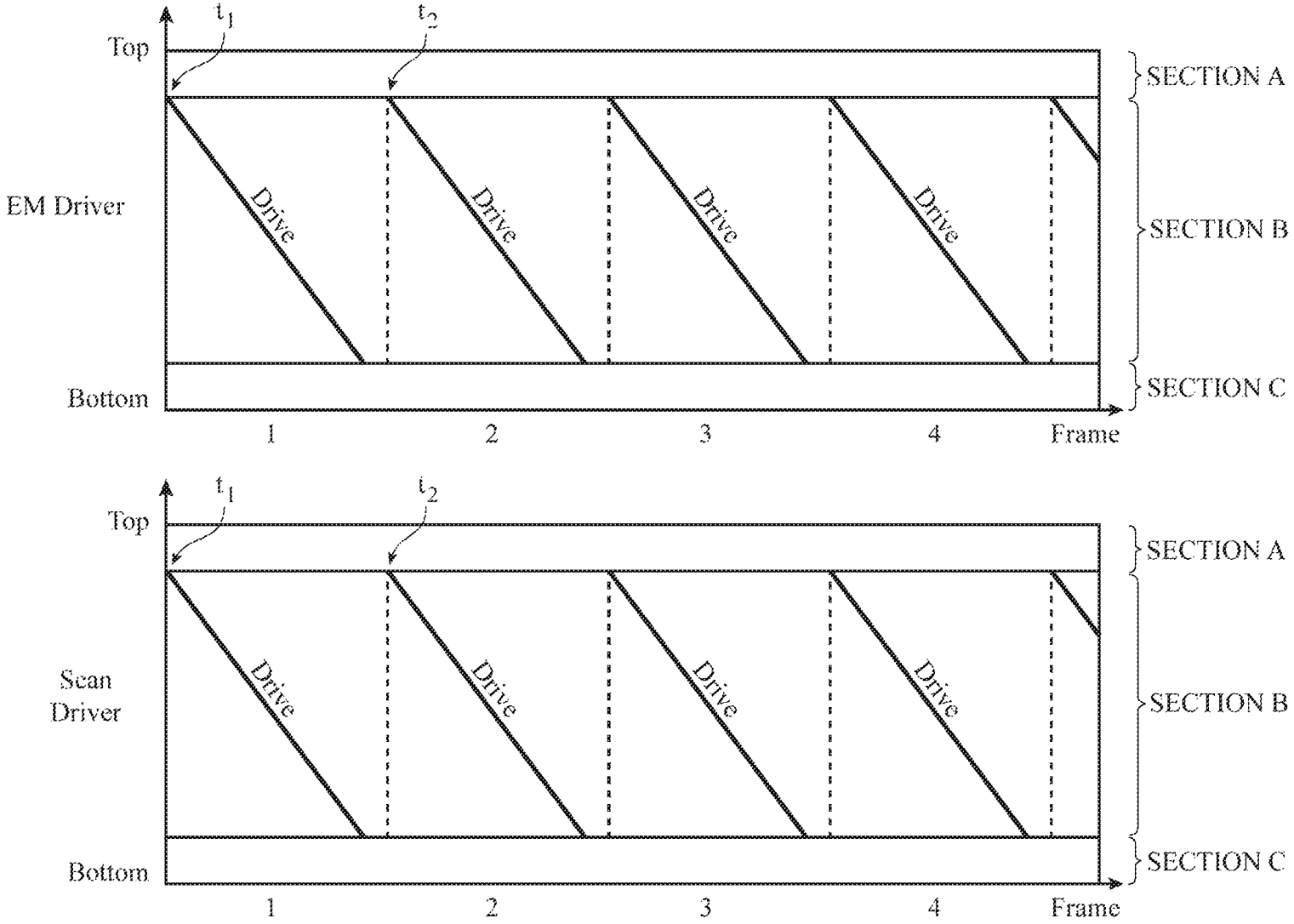
FIG. 17 is a diagram showing the scanning scheme of an illustrative display while the display operates in a partial scanning mode using the scan driver of FIG. 15 in accordance with an embodiment.

FIGS. 16 and 17 are timing diagrams of an illustrative display operating in a normal scanning mode and a partial scanning mode. FIG. 16 shows the display operating in a normal scanning mode. At $t_1$, the first row of the display (i.e., the row at the top of the active area of the display) may be scanned by the scan driver and driven by the emission driver. Each subsequent row of the display may then be scanned. At the bottom of the display, the last row of the display may be scanned as the frame duration (e.g., $1/60^{th}$ of a second) elapses. After the last row of the display is scanned, there may be a vertical blanking period before the beginning of the next frame. At $t_2$, the first row may be scanned again as the second frame begins. This pattern may continue with every row in the display being scanned once during each frame.

In certain situations (i.e., when the display is operating in a virtual reality mode), it may be desirable for the display to have a higher refresh rate. To reduce artifacts and still operate at a high refresh rate, the display may optionally operate in a partial scanning mode. FIG. 17 shows the display operating in a partial scanning mode. At $t_1$, the first row of section B of the display may be scanned. Each subsequent row of section B of the display may then be scanned. The rows of section A and section C may not be scanned or emit light when the display operates in the partial scanning mode.

Any suitable refresh rates and frame durations may be used in the partial scanning mode and normal scanning mode. For example, the display may operate with a refresh rate of 60 Hz, a refresh late less than 60 Hz, or a refresh rate greater than 60 Hz in the normal scanning mode. The display may operate with a refresh rate of 75 Hz, 96 Hz, a refresh rate less than 75 Hz, or a refresh rate greater than 75 Hz in the partial scanning mode. In general, the display may operate at any desired refresh rate during the normal scanning mode and at any desired refresh rate during the partial scanning mode. However, during the normal scanning mode all of the rows of the display may be scanned whereas during the partial scanning mode only some of the rows of the display may be scanned.

Figure 18:
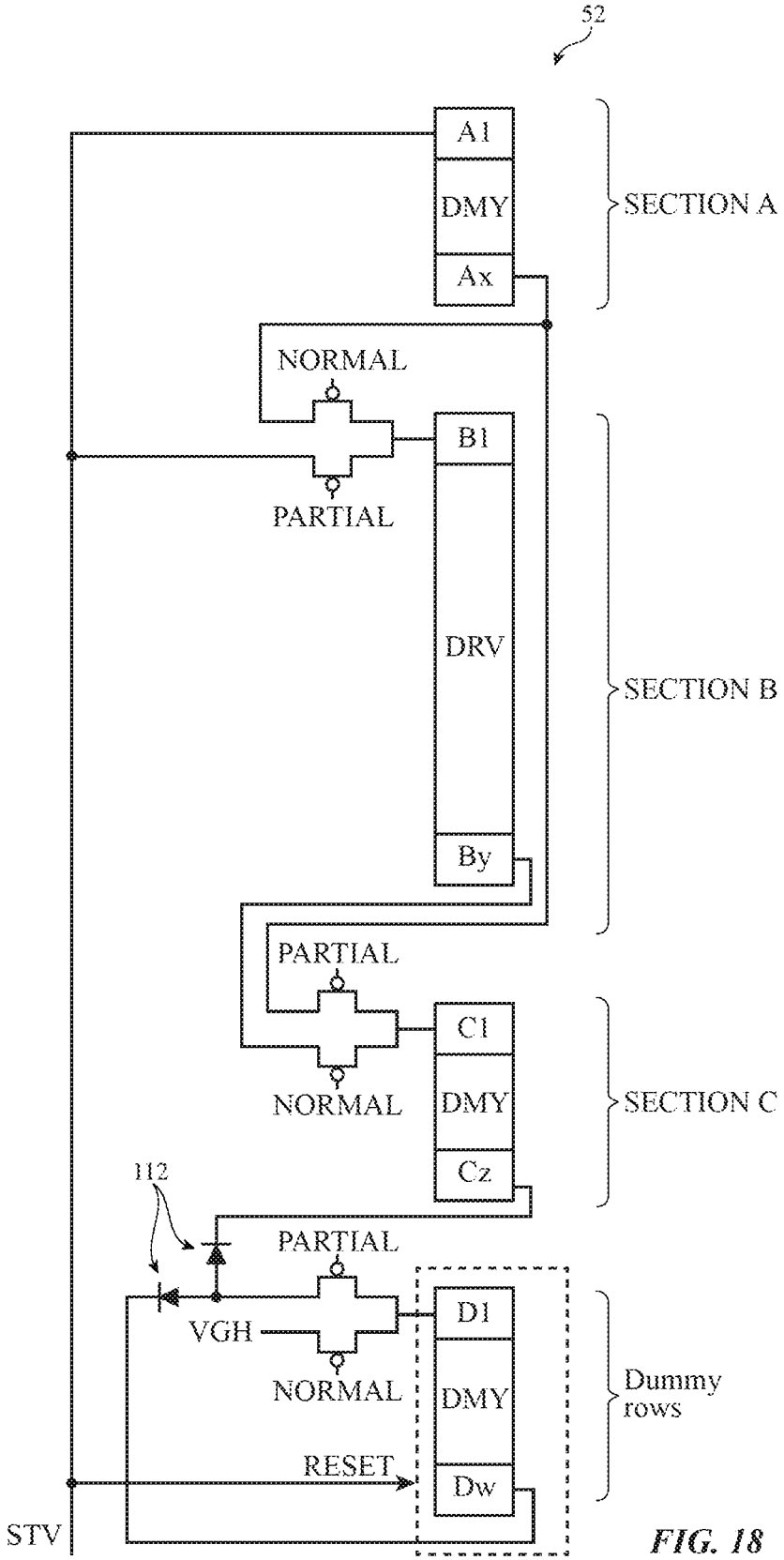
FIG. 18 is a diagram of an illustrative scan driver that scans disabled rows of the display in the partial scanning mode in accordance with an embodiment.

FIG. 18 is a diagram of an illustrative scan driver that scans disabled rows of the display in a partial scanning mode (e.g., FIG. 14C). As shown in FIG. 18, scan driver 52 may include sections A, B, and C. Section A may have a register circuit A1 associated with the first row of section A and a register circuit Ax associated with the last row of section A. Section B may have a register circuit B1 associated with the first row of section B and a register circuit By associated with the last row of section B. Section C may have a register circuit C1 associated with the first row of section C and a register circuit Cz associated with the last row of section C. Scan driver 52 may also include a section for dummy rows positioned below the active area of the display. The dummy rows may have a register circuit D1 associated with the first dummy row and a register circuit Dw associated with the last dummy row. Scan driver 52 of FIG. 18 may be operable in a normal scanning mode in which all of the rows in the display are used to display an image and a partial scanning mode in which only some of the rows in the display are used to display an image. When in the normal scanning mode, the "NORMAL" signal may be asserted, whereas when in the partial scanning mode, the "PARTIAL" signal may be asserted. The NORMAL and PARTIAL signals may control the drive sequence used by the scan driver.

As shown in FIG. 18, when scan driver 52 is in the normal scanning mode, a control pulse STV will be provided to register circuit A1 of section A. After propagating through the register circuits of section A, the control signal will be passed from the last register circuit of section A (Ax) to the first register circuit of section B (B1). After propagating through the register circuits of section B, the control signal will be passed from the last register circuit of section B (By) to the first register circuit of section C (C1).

When scan driver 52 is in the partial scanning mode, control pulse STV will be simultaneously provided to register circuit A1 of section A and register circuit B1 of section B. The control signal received by register circuit B1 will be propagated through section B. The control signal received by register circuit A1 will be propagated through section A then passed from the last register circuit of section A (Ax) to the first register circuit of section C (C1).

After being propagated through the register circuits of section C, the scanning of the disabled rows could conclude. However, concluding the scan of the disabled rows while scanning the enabled rows may cause a sudden drop in loading for the enabled rows. To avoid imbalanced loading of the enabled rows, dummy rows may be provided below the active area. The control signal may be passed from the last register circuit of section C (Cz) to the register circuit of the first dummy row (D1). After being propagated through the register circuits of the dummy rows, the control signal may be cycled from the last register circuit of the dummy rows (Dw) back to the register circuit of the first dummy row (D1). The control signal may continue to be cycled through the dummy rows for the duration of the frame to ensure that the enabled rows have uniformed loading. The scan driver may include diodes 112 to ensure the control signal only proceeds in the desired direction. The dummy rows below the active area may be disabled during the normal scanning mode.

Figure 19:
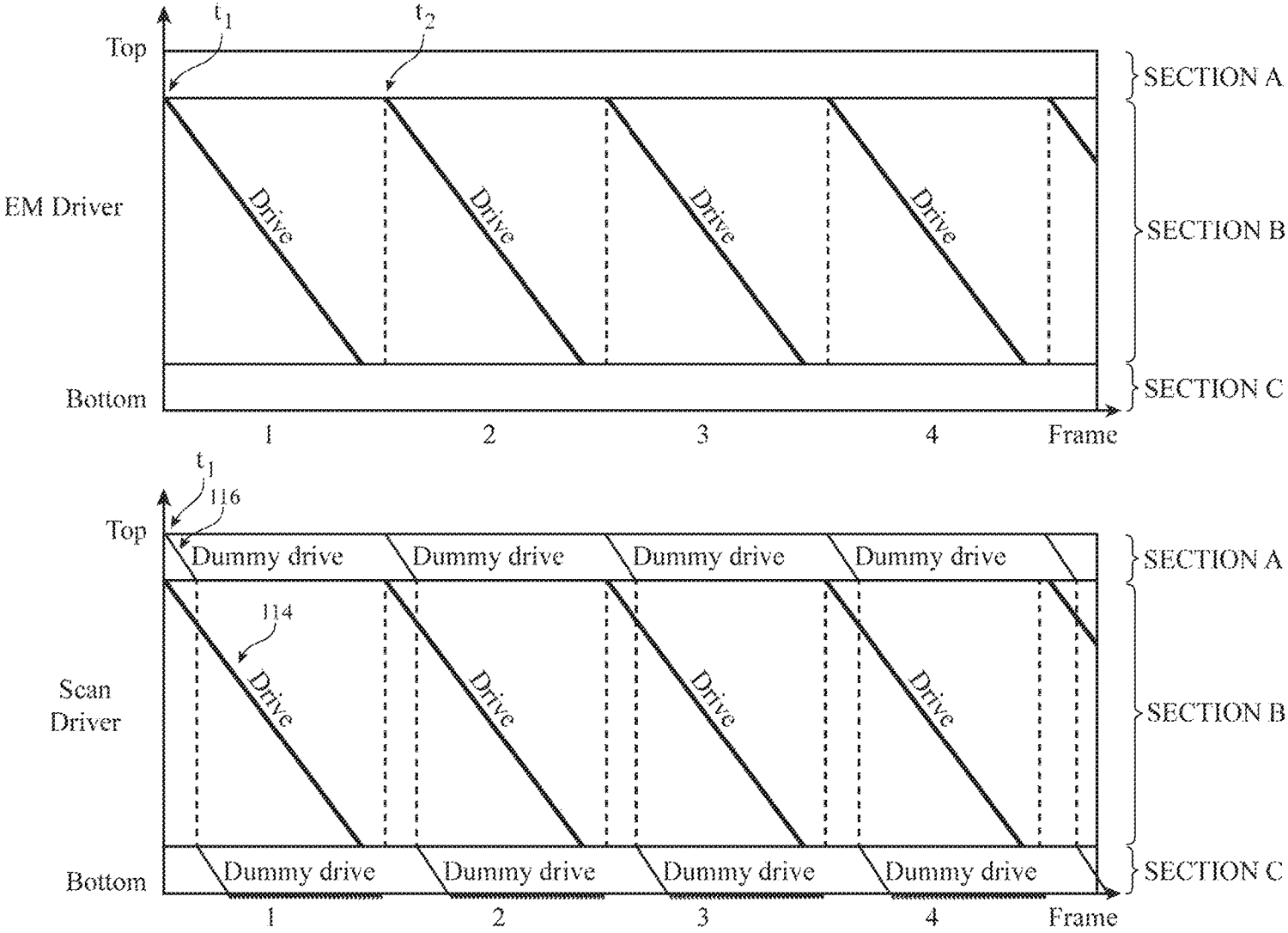
FIG. 19 is a diagram showing the scanning scheme of an illustrative display while the display operates in a partial scanning mode using the scan driver of FIG. 18 in accordance with an embodiment.

FIG. 19 is a diagram showing the scanning scheme of an illustrative display while the display operates in a partial scanning mode using the scan driver of FIG. 18. The emission driver may operate similarly to the emission driver of FIG. 17. At $t_1$, the emission transistors of the first row of section B of the display may be asserted. Each subsequent row of section B of the display may then receive a pulse from the emission driver. The rows of section A and section C may not emit light when the display operates in the partial scanning mode.

The scanning driver may have a different driving scheme than the emission driver. At $t_1$, the first row of section B of the display may be scanned, and each subsequent row of section B of the display may then be scanned (similar to the emission driver). This may be the primary drive sequence 114 (labeled "DRIVE") in FIG. 19 that is used for the enabled rows. However, also at $t_1$, the first row of section A of the display may be scanned. Each subsequent row of section A of the display may then be scanned. After the last row in section A is scanned, the first row of section C may be scanned. Each subsequent row of section C of the display may then be scanned. After the last row in section C is scanned, the first dummy row may be scanned. The dummy rows may then be repeatedly scanned until the end of the frame to ensure balanced loading of the enabled rows. The scanning of the rows that are not used to emit light may sometimes be referred to as dummy drive sequence 116 (labeled "DUMMY DRIVE" in FIG. 19)

Figure 20:
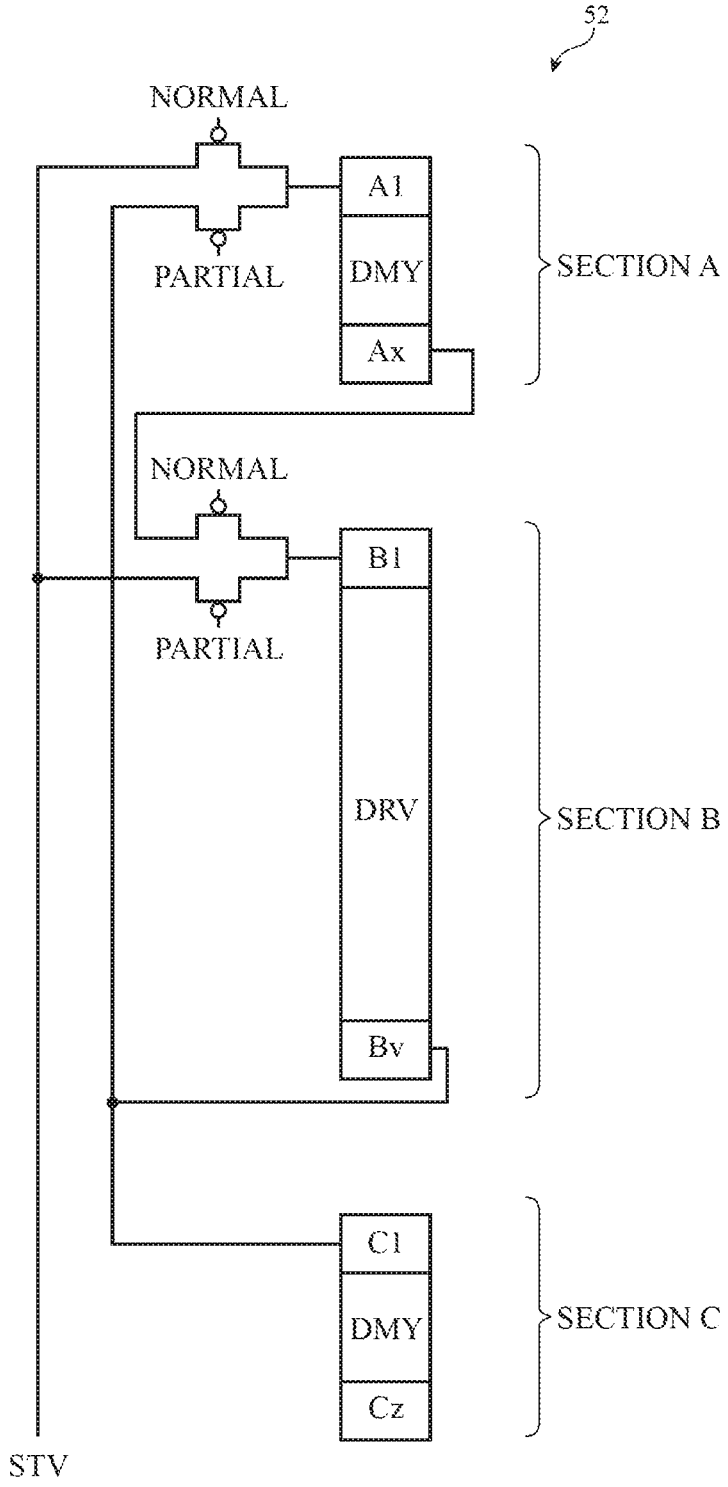
FIG. 20 is a diagram of an illustrative scan driver that scans disabled rows of the display in the partial scanning mode during the vertical blanking period in accordance with an embodiment.

FIG. 20 is a diagram of an illustrative scan driver that scans disabled rows of the display during the vertical blanking period in a partial scanning mode (e.g., FIG. 14D). As shown in FIG. 20, scan driver 52 may include sections A, B, and C. Section A may have a register circuit A1 associated with the first row of section A and a register circuit Ax associated with the last row of section A. Section B may have a register circuit B1 associated with the first row of section B and a register circuit By associated with the last row of section B. Section C may have a register circuit C1 associated with the first row of section C and a register circuit Cz associated with the last row of section C. Scan driver 52 of FIG. 20 may be operable in a normal scanning mode in which all of the rows in the display are used to display an image and a partial scanning mode in which only some of the rows in the display are used to display an image. When in the normal scanning mode, the "NORMAL" signal may be asserted, whereas when in the partial scanning mode, the "PARTIAL" signal may be asserted. The NORMAL and PARTIAL signals may control the drive sequence used by the scan driver.

As shown in FIG. 20, when scan driver 52 is in the normal scanning mode, a control pulse STV will be provided to register circuit A1 of section A. After propagating through the register circuits of section A, the control signal will be passed from the last register circuit of section A (Ax) to the first register circuit of section B (B1). After propagating through the register circuits of section B, the control signal will be passed from the last register circuit of section B (By) to the first register circuit of section C (C1).

When scan driver 52 is in the partial scanning mode, control pulse STV will initially be provided to register circuit B1 of section B. The control signal received by register circuit B1 will be propagated through section B. The control signal will then be passed from the last register circuit of section B (By) to at least one of the disabled rows. In FIG. 20, the control signal is passed from the last register circuit of section B to the first register circuit of section A (A1) and the first register circuit of section C (C1). Providing the control signal to multiple rows in parallel may be necessary to scan all of the disabled rows during the vertical blanking period. The example of FIG. 20 in which the control signal is passed from the last register circuit of section B to two disabled rows in parallel is merely illustrative. If desired, the control signal may be passed from the last register circuit of section B to any desired number of rows in parallel (e.g., three disabled rows in parallel, four disabled rows in parallel, six disabled rows in parallel, ten disabled rows in parallel, more than one disabled row in parallel, more than four disabled rows in parallel, etc.).

Figure 21:
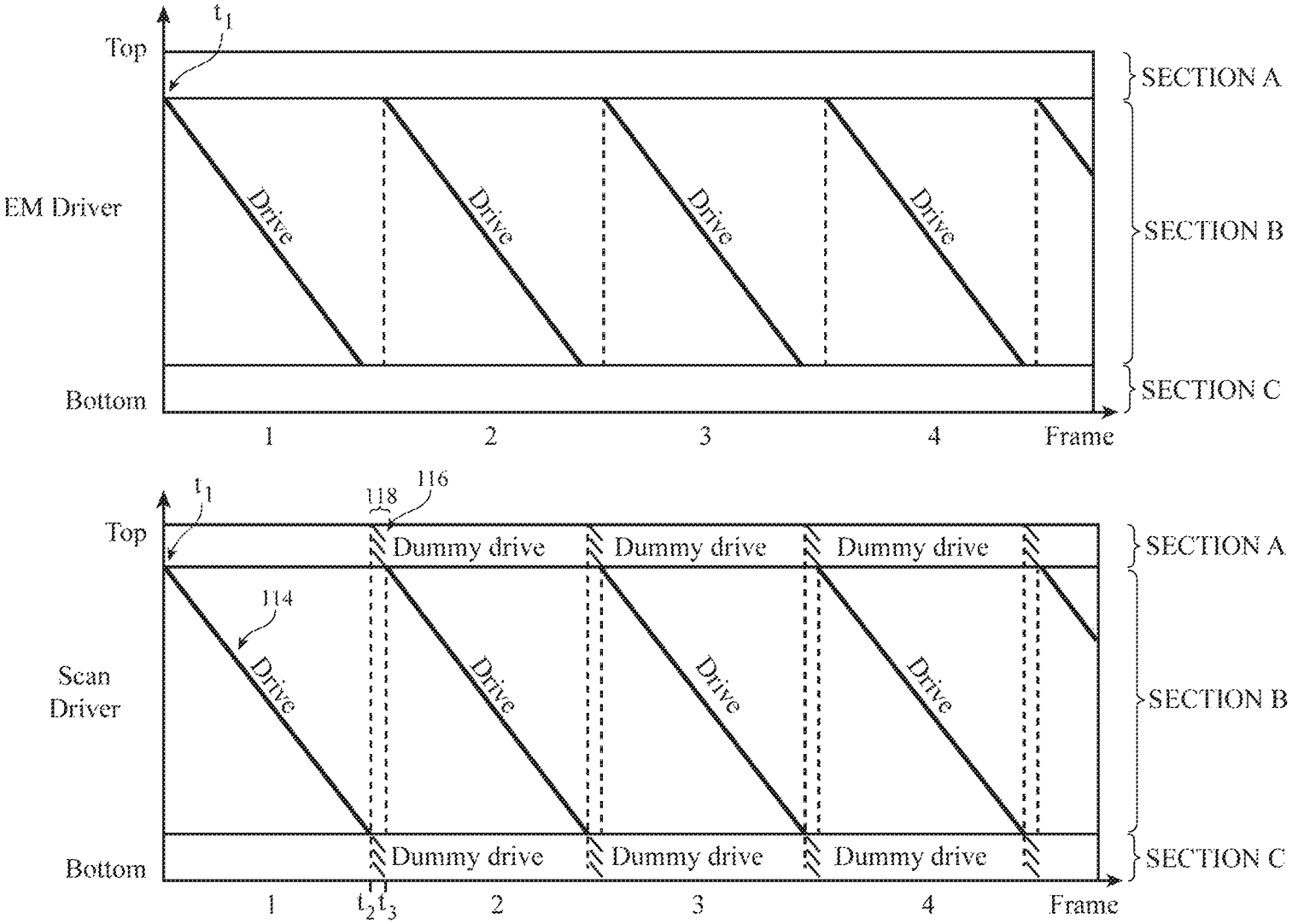
FIG. 21 is a diagram showing the scanning scheme of an illustrative display while the display operates in a partial scanning mode using the scan driver of FIG. 20 in accordance with an embodiment.

FIG. 21 is a diagram showing the scanning scheme of an illustrative display while the display operates in a partial scanning mode using the scan driver of FIG. 20. The emission driver may operate similarly to the emission drivers of FIGS. 17 and 19. At $t_1$, the emission transistors of the first row of section B of the display may be asserted. Each subsequent row of section B of the display may then receive a pulse from the emission driver. The rows of section A and section C may not emit light when the display operates in the partial scanning mode.

The scanning driver may have a different driving scheme than the emission driver. At $t_1$, the first row of section B of the display may be scanned, and each subsequent row of section B of the display may then be scanned (similar to the emission driver). This may be the primary drive sequence 114 (labeled "DRIVE") in FIG. 21 that is used for the enabled rows. However, at $t_2$, after the primary drive sequence has concluded, there may be a vertical blanking period 118 between the start of the next frame at $t_3$. During this period, the dummy drive sequence 116 (labeled "DUMMY DRIVE") may occur. During the dummy drive sequence, a number of rows may be scanned in parallel. FIG. 21 shows three rows in section A and three rows in section C (six rows total) being scanned in parallel. This example is merely illustrative and any desired number of rows may be scanned in parallel to ensure that all of the disabled rows are scanned during the vertical blanking period.

Figure 22:
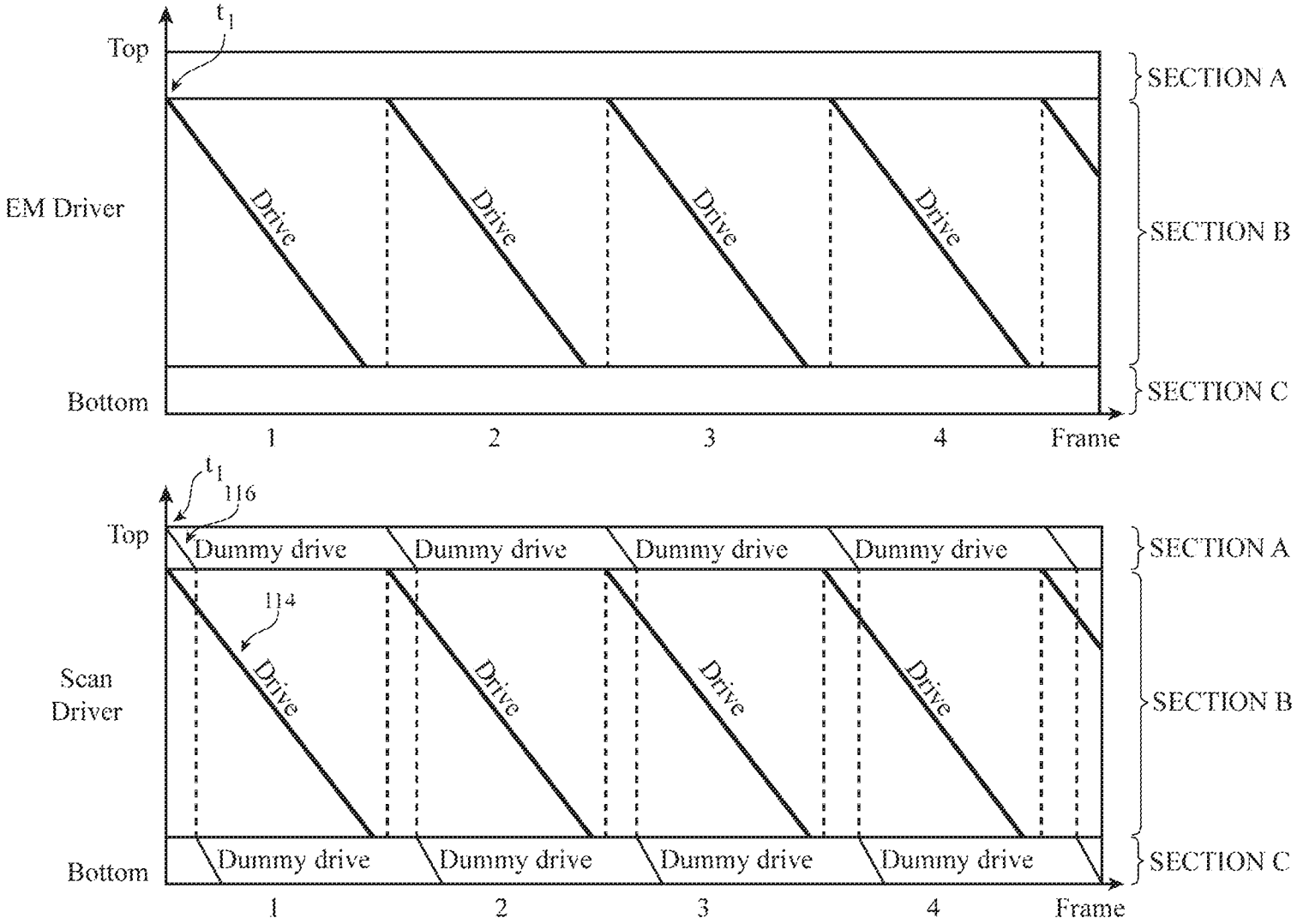
FIG. 22 is a diagram showing the scanning scheme of an illustrative display that uses four clock signals while the display operates in a partial scanning mode in accordance with an embodiment.

FIG. 22 is a diagram showing the scanning scheme of an illustrative display while the display operates in a partial scanning mode. The emission driver may operate similarly to the emission drivers of FIGS. 17, 19, and 21. At $t_1$, the emission transistors of the first row of section B of the display may be asserted. Each subsequent row of section B of the display may then receive a pulse from the emission driver. The rows of section A and section C may not emit light when the display operates in the partial scanning mode.

The scanning driver may have a different driving scheme than the emission driver. At $t_1$, the first row of section B of the display may be scanned, and each subsequent row of section B of the display may then be scanned (similar to the emission driver). This may be the primary drive sequence 114 (labeled "DRIVE") in FIG. 21 that is used for the enabled rows. However, also at $t_1$, the first row of section A of the display may be scanned. Each subsequent row of section A of the display may then be scanned. After the last row in section A is scanned, the first row of section C may be scanned. Each subsequent row of section C of the display may then be scanned. The scanning of the rows that are not used to emit light may sometimes be referred to as dummy drive sequence 116 (labeled "DUMMY DRIVE" in FIG. 21).

The dummy drive sequence of FIG. 22 is similar to the dummy drive sequence of FIG. 19. In both FIGS. 19 and 22, the dummy drive sequence occurs in parallel with the primary drive sequence. However, in FIG. 19 dummy rows in the inactive area are repeatedly scanned to avoid a sudden drop in loading during the primary drive sequence. In FIG. 22, the change in loading is instead avoided by using 4-phase clock signals. In FIG. 19, two clock signals may be used to scan both the enabled rows and the disabled rows. In contrast, in FIG. 22 four clock signals may be used to scan the enabled and disabled rows, with a first two clock signals being used to scan the enabled rows and a second two clock signals being used to scan the disabled rows. This avoids the drop in loading when the scan of the disabled rows is completed.

Figure 23B:
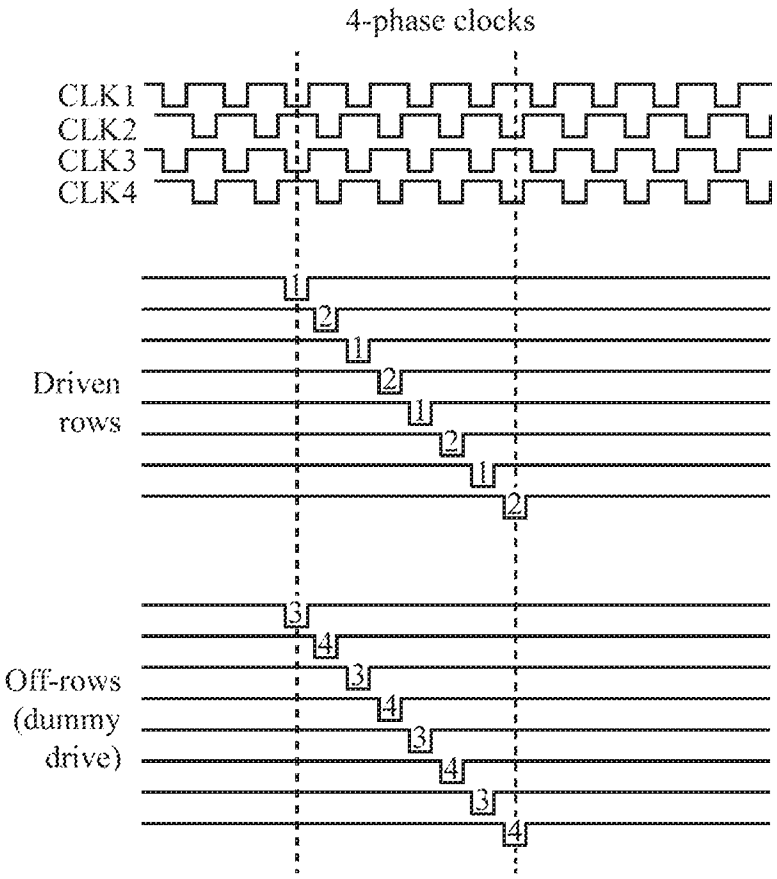
FIGS. 23A and 23B are illustrative timing diagrams of clock signals and the gate signals asserted by a scanning driver in accordance with an embodiment.
Figure 23A:
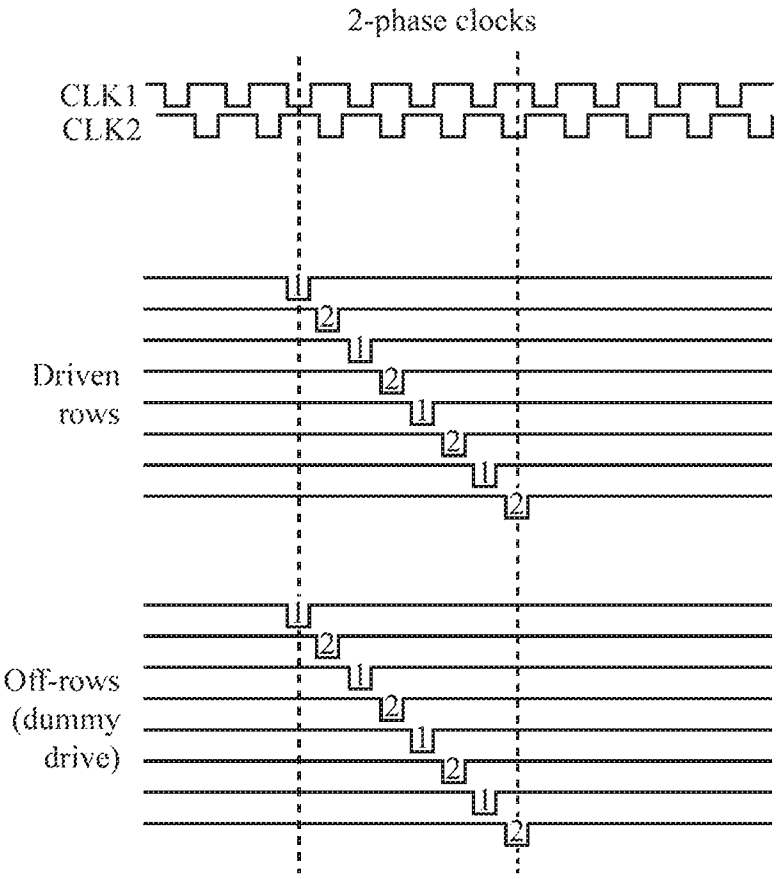

FIGS. 23A and 23B are illustrative timing diagrams of clock signals and the gate signals asserted by the scanning driver. FIG. 23A shows two clock signals (CLK1 and CLK2) that are asserted and deasserted in known patterns. The clock signals may control the operation of the scan driver. The clock signals may also be used to operate the emission driver if desired. FIG. 23A shows signals asserted by the scanning driver in the driven rows (i.e., the rows that emit light in the partial scanning mode such as the rows in section B) and the off-rows (i.e., the rows that are disabled during the partial scanning mode such as the rows in sections A and C). In particular, the driven rows use the two clock signals to scan the rows of the display, and the off-rows use the same two clock signals to scan the rows of the display. A scheme as shown in FIG. 23A may be described as a two-phase clock and may be used in the drive sequence shown in FIG. 19, for example.

FIG. 23B shows four clock signals (CLK1, CLK2, CLK3, and CLK4) that are asserted and deasserted in known patterns. The clock signals may control the operation of the scan driver. The clock signals may also be used to operate the emission driver if desired. FIG. 23A shows signals asserted by the scanning driver in the driven rows (i.e., the rows that emit light in the partial scanning mode such as the rows in section B) and the off-rows (i.e., the rows that are disabled during the partial scanning mode such as the rows in sections A and C). The driven rows may use the first two clock signals (CLK1 and CLK2) to scan the enabled rows of the display. The off-rows may use the second two clock signals (CLK3 and CLK4) to scan the disabled rows of the display. A scheme as shown in FIG. 23B may be described as a four-phase clock and may be used in the drive sequence shown in FIG. 22, for example.

The embodiments for a display with three sections and corresponding emission and scan drivers shown in FIGS. 13-23 are merely illustrative. The display may have any desired number of sections that are enabled or disabled during a partial scanning mode. The concept of scanning the disabled rows to ensure uniform transistor stress across the display may be applied to the display regardless of the number and geometry of the enabled and disabled sections of the display.

In FIGS. 9-23, embodiments were described where the emission driver and scanning driver of a display are split into different sections (as shown in FIG. 9, for example). However, these examples are merely illustrative. In some cases, it may be desirable to operate a display in a partial scanning mode using the emission driver and scanning driver shown in FIG. 4. To operate this type of emission driver and scan driver, a start pulse is provided to the driver at the first row that propagates sequentially through all of the rows in the display. However, a partial scanning mode may be enabled by sending the start pulse for a subsequent frame before the current frame finishes scanning, as shown in FIG. 24.

Figure 24:
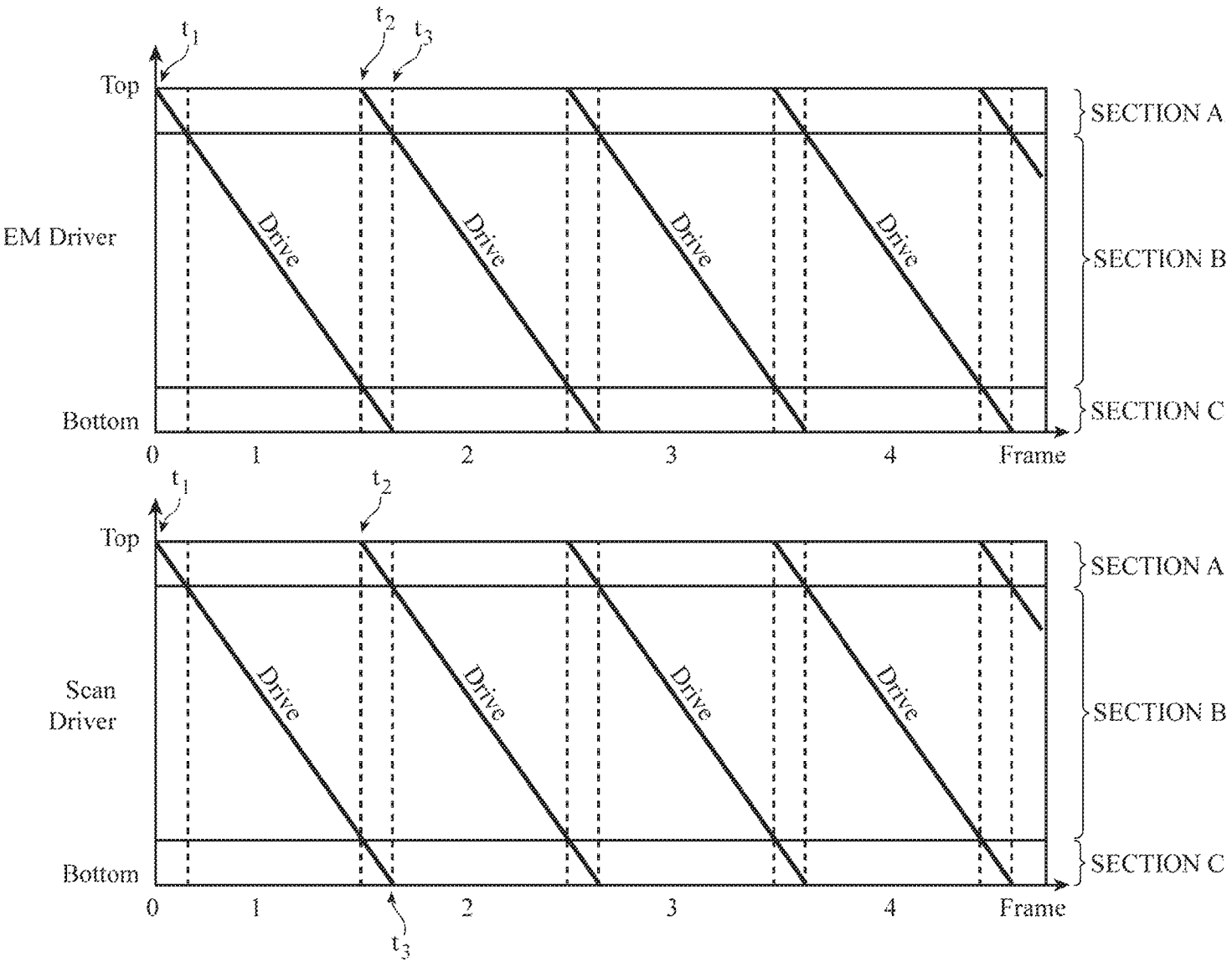
FIG. 24 is a diagram showing the scanning scheme of an illustrative display that begins scanning the next frame before finishing the scanning of the current frame in accordance with an embodiment.

FIG. 24 is a diagram showing the scanning scheme of an illustrative display while the display operates in a partial scanning mode. The scanning driver and emission driver may operate similarly to the drivers described in connection with FIGS. 4-8. At $t_1$, the emission transistors of the first row of section A of the display may be asserted. Each subsequent row of the display may then receive a pulse from the emission driver. Similarly, at $t_1$, the first row of section A of the display may be scanned, and each subsequent row of the display may then be scanned (similar to the emission driver). However, when section A and section C of the display are scanned, they may be scanned with a value that leads to the pixel appearing black when the emission transistors are asserted. Every row in section A and section C may be scanned with this "black level." Additionally, because the pixels in section A and section C will all be loaded with the same value, the pixels in section A and section C can be scanned simultaneously.

The driving scheme of FIG. 24 takes advantage of the fact that pixels in section A and section C can be scanned simultaneously. As previously discussed, scanning of frame 1 in FIG. 24 begins at $t_1$. The scanning may progress through the rows and finish at $t_3$. However, the start pulse to begin scanning of frame 2 may occur at $t_2$, before scanning of the first frame concludes. Therefore, there is a time period (between $t_2$ and $t_3$) when pixels in section A and section C are being scanned simultaneously. The scanning of each frame may begin before the scanning of the previous frame concludes.

By using the driving scheme of FIG. 24, no additional transistors nor signals are required for realizing the proposed driving scheme. In other words, the hardware required to operate the display in the normal display mode is sufficient to also operate the display in the partial display mode. Therefore, any type of shift register may be used to form the emission driver and the scan driver, and the shift register may still be functional in the partial display mode. Ensuring that no additional components are necessary for the partial display mode also helps maintain a narrow display border for the display.

Figure 25:
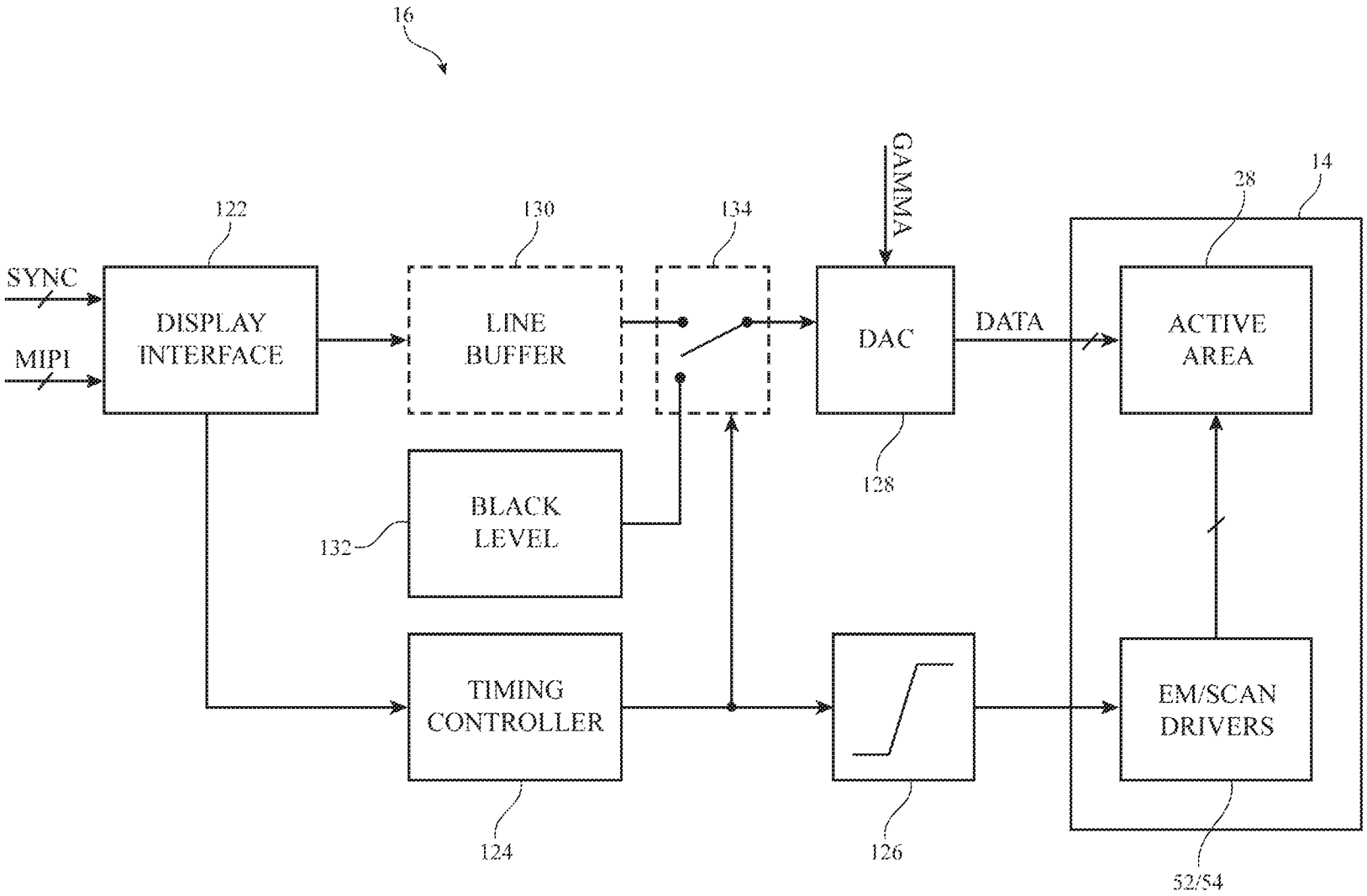
FIG. 25 is a schematic diagram of illustrative circuitry used to operate a display in accordance with an embodiment.

FIG. 25 is a schematic diagram of a display and control circuitry that may be used to operate the display. As shown in FIG. 25, display 14 includes pixel array 28 (sometimes referred to as the active area) that receives control signals from emission driver 54 and scan driver 52.

Control circuitry may provide signals to pixel array 28 and drivers 52/54 to control display 14. As shown, control circuitry 16 may include a display interface (MIPI PHY) 122 that receives timing signals (SYNC) and pixel data packets (MIPI). Display interface 122 may provide corresponding timing signals to timing controller (ICON) 124. Timing controller 124 may provide signals to emission driver 54 and scanning driver 52 through level shifter 126. Display interface 122 may also provide pixel data packets to the active area of the display through digital-to-analog converter (DAC) 128. The digital-to-analog converter may receive digital pixel values as input and output corresponding analog pixel values to the pixels in pixel array 28. DAC 128 may receive gamma values to help convert the pixel data to the analog domain. DAC 128 may receive analog pixel data from display interface 122 or black level provider 132. When receiving pixel data from display interface 122, the pixel data may optionally be held in line buffer 130. Switch 134 may determine whether the DAC receives pixel data from display interface 122 or black level provider 132 by coupling the DAC to either the display interface (optionally via the line buffer) or the black level provider. Switch 134 may additionally receive timing signals from timing controller 124. When dark areas of the display are being scanned (i.e., section A and section C of the display in FIG. 24), the DAC may be coupled to the black level provider so that pixels in section A and section C appear black. When the non-dark areas of the display are being scanned (i.e., section B in FIG. 24), the DAC may be coupled to the display interface so that the pixels may be scanned with pixel data.

Figure 26:
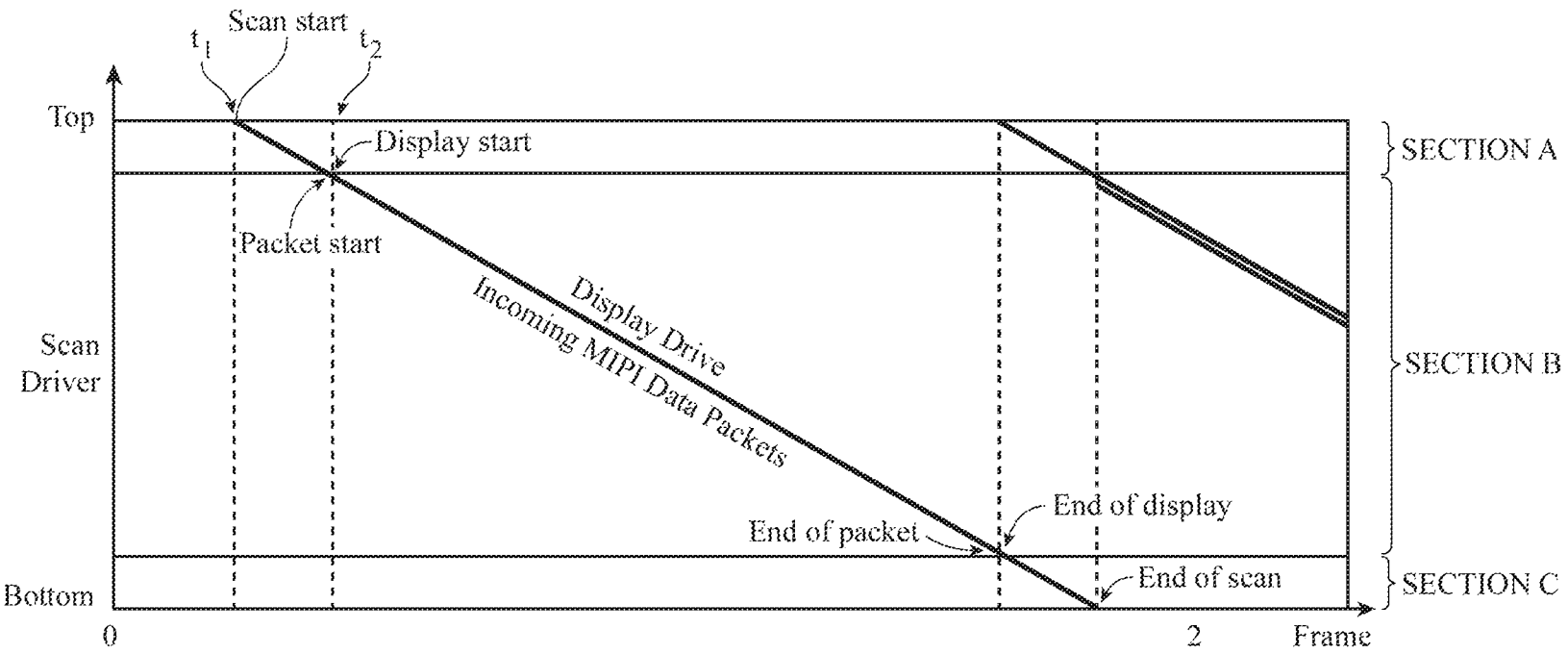
FIGS. 26 and 27 are diagrams showing illustrative scanning schemes for performing a scan of the type shown in FIG. 24 in accordance with an embodiment.
Figure 27:
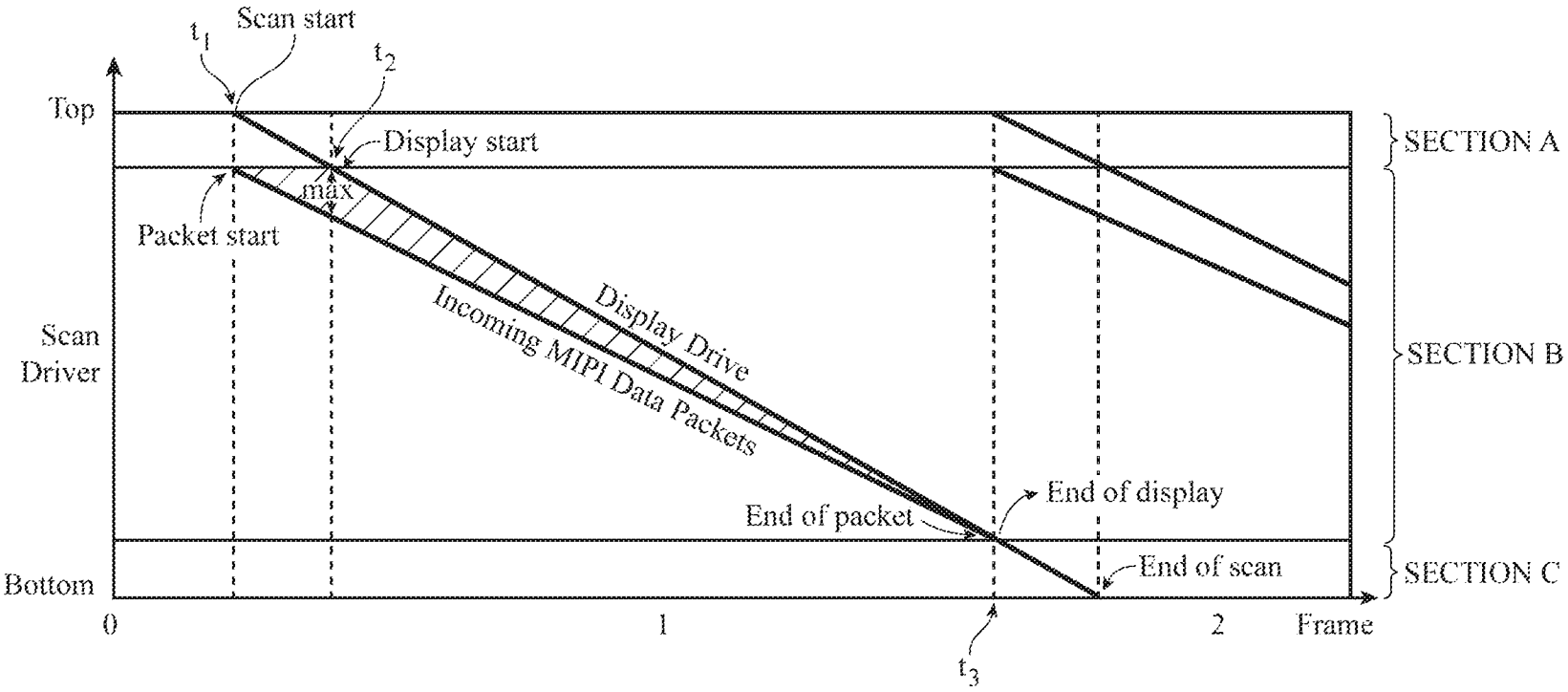

FIGS. 26 and 27 are diagrams illustrating different schemes for the timing of incoming pixel data packets while using the scanning driver scheme of FIG. 24. FIG. 26 shows an embodiment where a line buffer is not required to store pixel data. In FIG. 26, although the scanning of the rows may begin at $t_1$, the incoming pixel data packets may not be received until $t_2$ (because the black level provider 132 may provide the pixel values to DAC 128 while sections A and C are being scanned). At $t_2$, when the scan of section B begins, display interface 122 may begin receiving pixel packets (MIPI) that can be provided directly to DAC 128 without an intervening line buffer.

In another embodiment shown in FIG. 27, the scanning of the rows may begin at $t_1$ (similar to FIG. 26). The incoming pixel data packets (for section B of the display) may also be received starting at $t_1$. However, because the pixel data packets are not needed until $t_2$, when scanning of section B begins, the pixel data packets may be stored in liner buffer 130. The line buffer may be filled to its largest capacity (max) at $t_2$. At $t_2$, the pixel data packets will start being provided to DAC 128 and the amount of data in the line buffer may gradually decrease until $t_3$ when scanning of section B is complete.

In various embodiments, a display may include an array of pixels formed in an active area of the display that includes rows and columns of pixels, display driver circuitry formed in an inactive area of the display that is configured to provide image data to the pixels, and gate driver circuitry formed in the inactive area of the display. The gate driver circuitry may include an emission driver and a gate driver, the emission driver may include a first portion that is associated with a first portion of the array of pixels, the gate driver may include a first portion that is associated with the first portion of the array of pixels, the first portion of the emission driver may be disabled while operating in a partial scanning mode to prevent the first portion of the array of pixels from emitting light, and the first portion of the gate driver may scan the pixels in the first portion of the array of pixels while operating in the partial scanning mode.

The emission driver may include a second portion associated with a second portion of the array of pixels, the gate driver may include a second portion associated with the second portion of the array of pixels, and the second portion of the emission driver and the second portion of the gate driver may be configured to scan the pixels in the second portion of the array of pixels while operating in the partial scanning mode. Both the first and second portions of the array of pixels may be used to emit light in a normal scanning mode.

The second portion of the emission driver may be configured to receive a first control pulse at the beginning of each frame while operating in the partial scanning mode, and the second portion of the gate driver may be configured to receive a second control pulse at the beginning of each frame while operating in the partial scanning mode. The first portion of the gate driver may be configured to receive a third control pulse at the beginning of each frame while operating in the partial scanning mode. The second control pulse and the third control pulse may be received simultaneously by the gate driver. The display may also include pixels formed below the active area of the display in dummy rows. The first portion of the gate driver may be configured to propagate the third control pulse throughout all of the rows of pixels in the first portion of the array of pixels, and after being propagated throughout all of the rows of pixels in the first portion of the array of pixels the control pulse may be configured to be passed to the dummy rows. The control pulse may be configured to be repeatedly cycled through the dummy rows until the end of each frame. The first portion of the gate driver may be configured to scan the pixels in the first portion of the array of pixels using first clock signals, and the second portion of the gate driver may be configured to scan the pixels in the second portion of the array of pixels using second clock signals that are independent of the first clock signals.

The second portion of the gate driver may be configured to receive a control pulse at the beginning of each frame while operating in the partial scanning mode, the second portion of the gate driver may be configured to propagate the control pulse throughout all of the rows of pixels in the second portion of the array of pixels, and after being propagated throughout all of the rows of pixels in the second portion of the array of pixels the control pulse may be configured to be passed to the first portion of the gate driver. The first portion of the gate driver may be configured to scan the first portion of the array of pixels during a vertical blanking period of each frame. The gate driver may have a register circuit associated with each row in the array of pixels, and the control pulse may be configured to be passed in parallel from the second portion of the gate driver to multiple register circuits of the first portion of the gate driver.

In various embodiments, a display may include a plurality of display pixels arranged in rows and columns, display driver circuitry configured to provide image data for a frame to the display pixels, an emission driver, and a scan driver. The emission driver may include a shift register and may be configured to assert emission control signals in sequence, the emission driver may be configured to operate in a normal scanning mode in which emission control signals are supplied to every row of display pixels in each frame, and the emission driver may be configured to operate in a partial scanning mode in which the emission control signals are supplied to only a subset of the rows of display pixels in each frame. The scan driver may include a shift register configured to scan rows of display pixels by asserting gate line signals in sequence, in the normal scanning mode every row of display pixels may be scanned in each frame by the scan driver, and in the partial scanning mode every row of display pixels may be scanned in each frame by the scan driver.

The scan driver may include a first portion associated with a first plurality of rows of display pixels, a second portion associated with a second plurality of rows of display pixels, and a third portion associated with a third plurality of rows of display pixels. The second plurality of rows of display pixels may be interposed between the first and third pluralities of rows of display pixels, and the first and third pluralities of rows of display pixels may not emit light in the partial scanning mode. The shift register of the scan driver may have a register circuit associated with each row of display pixels, in the partial scanning mode a first control pulse may be provided to a first register circuit in the first portion of the scan driver associated with a first row of the first plurality of rows of display pixels, in the partial scanning mode a second control pulse may be provided to a second register circuit in the second portion of the scan driver associated with a first row of the second plurality of rows of display pixels, and the first and second control pulses may be simultaneously provided to the first and second register circuits in the partial scanning mode. The first portion of the scan driver may be configured to scan the first plurality of rows of display pixels using first and second clock signals, and the second portion of the scan driver may be configured to scan the second plurality of rows of display pixels using third and fourth clock signals that are different than the first and second clock signals.

The shift register of the scan driver may have a register circuit associated with each row of display pixels, in the partial scanning mode a control pulse may be provided to a first register circuit in the second portion of the scan driver associated with a first row of the second plurality of rows of display pixels, the control pulse may be propagated from the first register circuit to a last register circuit in the second portion of the scan driver associated with a last row of the second plurality of rows of display pixels, and the control pulse may be configured to be passed from the last register circuit in the second portion of the scan driver to a first register circuit in the first portion of the scan driver associated with a first row of the first plurality of rows of display pixels. The control pulse may be configured to be passed from the last register circuit in the second portion of the scan driver to a first register circuit in the third portion of the scan driver associated with a first row of the third plurality of rows of display pixels, and the control pulse may be configured to be passed in parallel from the last register circuit in the second portion of the scan driver to the first register circuit in the first portion of the scan driver and the first register circuit in the third portion of the scan driver.

In various embodiments, a display may be configured to operate in a first mode and a second mode and may include an active area with display pixels and gate driver circuitry that includes an emission driver and a scan driver. The active area may have a first portion and a second portion, the first and second portions may both be configured to emit light in the first mode, the first portion may be configured to emit light in the second mode, and the second portion may not emit light in the second mode. The emission driver may not address the second portion of the active area in the second mode, and the scan driver may not address the second portion of the active area in the second mode. The scan driver may address the second portion of the active area after addressing the first portion of the active area in each frame in the second mode. The scan driver may simultaneously address the first portion of the active area and the second portion of the active area in the second mode.

In various embodiments, a display may be operable in a normal scanning mode and a partial scanning mode. The display may include a plurality of display pixels arranged in rows and columns, display driver circuitry configured to provide image data to the display pixels, and a scan driver. The scan driver may include a shift register configured to scan rows of display pixels by asserting gate line signals in sequence, in both the normal scanning mode and the partial scanning mode every row of display pixels may be scanned sequentially in each frame by the scan driver, while operating in the normal scanning mode the scan driver may begin scanning a first row for a given frame after scanning a last row for a previous frame, and while operating in the partial scanning mode the scan driver may begin scanning the first row for the given frame before scanning the last row for the previous frame.

The display may also include an emission driver. The emission driver may include a shift register and may be configured to assert emission control signals in sequence. In both the normal scanning mode and the partial scanning mode emission control signals may be supplied to every row of display pixels sequentially in each frame by the emission driver, while operating in the normal scanning mode the emission driver may begin supplying emission control signals to the first row for the given frame after supplying emission control signals to the last row for the previous frame, and while operating in the partial scanning mode the emission driver may begin supplying emission control signals to the first row for the given frame before supplying emission control signals to the last row for the previous frame. After the scan driver begins scanning the first row for the given frame and before the scan driver begins scanning the last row for the previous frame in the partial scanning mode, at least two rows may be scanned simultaneously by the scan driver. The display may include a first subset of rows of display pixels, a second subset of rows of display pixels, and a third subset of rows of display pixels. The third subset of rows of display pixels may have a first row and a last row, the last row of the third subset of rows may be the last row of the plurality of display pixels, in the partial scanning mode the scan driver may begin scanning the first row for the given frame when the scan driver begins scanning the first row of the third subset of rows for the previous frame. The second subset of rows of display pixels may be interposed between the first and third subsets of rows of display pixels, and the first and third subsets of rows of display pixels may be dark in the partial scanning mode.

In various embodiments, a display may be operable in a normal scanning mode and a partial scanning mode. The display may include a plurality of display pixels arranged in rows and columns, display driver circuitry configured to provide image data to the display pixels, and a scan driver. The scan driver may include a shift register configured to scan rows of display pixels by asserting gate line signals in sequence, in the normal scanning mode every row of display pixels may be scanned sequentially in each frame by the scan driver, and in the partial scanning mode at least two rows of display pixels may be scanned simultaneously.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

an array of display pixels, wherein the array of display pixels comprises a first subset of rows, a second subset of rows, and a third subset of rows;

a scan driver, wherein the scan driver comprises a shift register configured to scan rows of display pixels by asserting gate line signals in sequence; and control circuitry, wherein the control circuitry comprises:

a display interface configured to generate pixel data for the array of display pixels;

a black level provider configured to generate a black level for the array of display pixels;

a digital-to-analog converter configured to convert data and provide the converted data to the array of display pixels;

a switch that is switchable between a first state in which the display interface provides the pixel data to the digital-to-analog converter and a second state in which the black level provider provides the black level to the digital-to-analog converter; and a timing controller that is configured to, during each frame of a partial scanning mode, place the switch in the second state while the first and third subsets of rows are being scanned by the scan driver and place the switch in the first state while the second subset of rows is being scanned by the scan driver, and, during each frame of a normal scanning mode, place the switch in the first state while the first, second, and third subsets of rows are being scanned by the scan driver.

2. The electronic device defined in claim 1, wherein the second subset of rows is interposed between the first subset of rows and the third subset of rows.

3. The electronic device defined in claim 2, wherein the scan driver is configured to simultaneously scan the first subset of rows and the third subset of rows in the partial scanning mode.

4. The electronic device defined in claim 1, wherein the scan driver is configured to simultaneously scan at least two rows of pixels at a time while the switch is in the second state.

5. A display comprising:

an array of display pixels arranged in rows and columns, wherein the array of display pixels has a first subset of rows, a second subset of rows that is different than the first subset, and a third subset of rows that is different than the first and second subsets and that is interposed between the first subset and the second subset;

display driver circuitry configured to provide image data to the display pixels; and a scan driver, wherein the scan driver comprises a shift register configured to scan rows of display pixels by asserting gate line signals in sequence, wherein the scan driver is configured to, in a first mode, simultaneously scan the first subset of rows and the second subset of rows, and wherein the scan driver is configured to, in a second mode, sequentially scan the first, third, and second subsets of rows in that order.

6. The display defined in claim 5, further comprising an emission driver, wherein the emission driver comprises a shift register and is configured to assert emission control signals in sequence.

7. The display defined in claim 6, wherein the emission driver is configured to simultaneously supply emission control signals to the first subset of rows and the second subset of rows.

8. A display operable in a first scanning mode and a second scanning mode, the display comprising:

a plurality of display pixels arranged in rows and columns;

display driver circuitry configured to provide image data to the display pixels; and a scan driver, wherein the scan driver comprises a shift register configured to scan rows of display pixels by asserting gate line signals in sequence, wherein while operating in the first scanning mode the scan driver begins scanning a first row for a given frame before scanning a last row for a previous frame, and wherein while operating in the second scanning mode the scan driver begins scanning a first row for a given frame after scanning a last row for a previous frame.

9. The display defined in claim 8, further comprising an emission driver, wherein the emission driver comprises a shift register and is configured to assert emission control signals in sequence.

10. The display defined in claim 9, wherein in the first scanning mode the emission control signals are supplied to every row of display pixels sequentially in each frame by the emission driver.

11. The display defined in claim 10, wherein while operating in the first scanning mode the emission driver supplies an emission control signal to the first row for the given frame before supplying an emission control signal to the last row for the previous frame.

12. The display defined in claim 8, wherein after the scan driver begins scanning the first row for the given frame and before the scan driver begins scanning the last row for the previous frame in the first scanning mode, at least two rows are scanned simultaneously by the scan driver.

13. The display defined in claim 12, wherein the display comprises a first subset of rows of display pixels, a second subset of rows of display pixels that is different than the first subset, and a third subset of rows of display pixels that is different than the first and second subsets.

14. The display defined in claim 13, wherein the third subset of rows of display pixels has a first row and a last row, wherein the last row of the third subset of rows is the last row of the plurality of display pixels, and wherein in the first scanning mode the scan driver begins scanning the first row for the given frame when the scan driver begins scanning the first row of the third subset of rows for the previous frame.

15. The display defined in claim 14, wherein the second subset of rows of display pixels is interposed between the first and third subsets of rows of display pixels.

16. The display defined in claim 15, wherein the first and third subsets of rows of display pixels are dark in the first scanning mode.

17. The display defined in claim 16, wherein the first row of the first subset of rows is the first row of the plurality of display pixels and wherein in the first scanning mode the scan driver begins scanning the first row of the first subset of rows at the same time as the first row of the third subset of rows.

* * * * *